US006871824B2

(12) United States Patent
Amamiya

(10) Patent No.: US 6,871,824 B2
(45) Date of Patent: Mar. 29, 2005

(54) POINTS DEVICE FOR TOY RAILWAY

(75) Inventor: Hiroki Amamiya, Misato (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 10/636,733

(22) Filed: Aug. 8, 2003

(65) Prior Publication Data

US 2004/0077282 A1 Apr. 22, 2004

(30) Foreign Application Priority Data

Aug. 22, 2002 (JP) ..... 2002-241690

(51) Int. Cl.[7] ..... B61L 5/00
(52) U.S. Cl. ..... 246/415 A
(58) Field of Search ..... 246/415 A, 221, 246/253, 382, 379, 377, 385, 454, 444; 104/295, 298; 238/10 R, 12, 10 B, 10 E, 14.05

(56) References Cited

U.S. PATENT DOCUMENTS 1,534,303 A * 4/1925 Cowen ..... 246/419
1,548,940 A * 8/1925 Gill ..... 246/231
1,607,337 A * 11/1926 Cooper ..... 238/12
1,671,971 A * 6/1928 Cooper ..... 246/386
1,692,367 A * 11/1928 Becker ..... 246/388
1,736,487 A * 11/1929 Cooper ..... 246/415 A
2,297,131 A * 9/1942 Bonanno ..... 246/220
4,355,776 A * 10/1982 Rydin ..... 246/415 A

FOREIGN PATENT DOCUMENTS

JP 9-84962 3/1997

OTHER PUBLICATIONS

Patent Abstracts of Japan, Publication No. 09–084962, Published Mar. 31, 1997.

* cited by examiner

*Primary Examiner*—Mark T. Le
(74) *Attorney, Agent, or Firm*—Staas & Halsey LLP

(57) ABSTRACT

A points device for toy railway includes a first outer rail, a second outer rail communicating with the first outer rail, a third outer rail, a fourth outer rail communicating with the third outer rail, inner rails disposed inside of the each outer rail, tongue rails for switching a traveling direction of a train, and a switch section interlocked with the tongue rail. The switch section electrically connects or disconnects the first outer rail with the second outer rail, a rail forming a pair with the first outer rail with a rail forming a pair with the second outer rail, the third outer rail with the fourth outer rail, and a rail forming a pair with the third outer rail with a rail forming a pair with the fourth outer rail, corresponding to the switching direction of the tongue rail.

9 Claims, 21 Drawing Sheets

POINTS DEVICE FOR TOY RAILWAY

BACKGROUND OF THE INVENTION

1. Field of the Invention

The present invention relates to a points device for toy railway. More particularly, the present invention relates to control of current-flow to rails, accompanying the switching of a points device.

2. Description of Related Art

The layout of a railway on which a model train car is allowed to run comprises a combination of a plurality of railway units such as straight railways, curved railways and points devices. A points device is used to switch traveling direction of a train approaching the points device and various types of points devices have been offered commercially ranging from multipurpose points devices in which a railway is branched to two railways to, for example, complicated structured points devices such as double-slip points and double-crossover points. A user can constitute a variety of layouts by using a points device corresponding to any applications.

For example, Japanese Patent Publication (Laid-open) No. Tokukai-hei-9-84962-A discloses a semi-selection type of points device for a model train car. This points device has a branched track, which curves from a straight to an oblique lateral direction. The straight track includes a pair of rails, one of which (outer rail) is positioned outside of the other comprising one rail connecting a root of the points device with an end of the straight line. The branch track includes a pair of rails, one of which (outer rail) is positioned outside of the other comprising one rail connecting a root of the points device with an end of the branch line. A current always flows in these outer rails irrespective of any switching direction of the points device. On the other hand, the condition of current-flow to an inner rail on a straight track and an inner rail on a branched track varies with the switching direction of the points device. When the switching direction is directed to the straight track side, although a current flows in the inner rail on the straight track, a current does not flow in the inner rail on the branched track side. On the contrary, when the switching direction is directed to the branched track side, although a current flows in the inner rail on the branched track side, a current does not flow in the inner rail on the straight track side. Thus, a system which also switches the current-flow to rails corresponding to the switching direction of a points device is called "a selection system", particularly, a system where the condition of current-flow to one rail (for example, inner rail) of a pair of rails forming a track is switched whereas the condition of current-flow to the other rail (for example, outer rail) is not switched (a current is always allowed to flow in the rail) is called "a semi-selection system".

When a semi-selection system of a points device is used in a layout, it is necessary to divide the layout into a plurality of railway blocks by arranging gaps and to control the current-flow to rails in every railway block. The term "a gap" means a clearance or a groove, and it is a cut-out portion of a rail or a railway in order to separate a current flowing in a rail from others. Since the polarities of a series of rails are the same in a simple layout such as an endless layout and the like where railways are laid in an oval shape, it is unnecessary to divide the layout into a plurality of railway blocks. However, since the polarities of a series of rails are reversed along the rails in a pattern where the traveling direction of a train is reversed such as a reverse layout where railways are laid in a P-shape, a short-circuit is caused thereby. In such a pattern, a gap is provided at both ends of reverse blocks to the current-flow thereto independently of the main track block. Since the number of divisions in railway blocks increases as the layout becomes complicated, it has a disadvantage that the current-flow control system of the layout becomes complicated corresponding thereto. In addition to the foregoing, it also has a disadvantage that it reduces operability and convenience since the user must frequently switch current-flow conditions while a train is allowed to run.

SUMMARY OF THE INVENTION

The present invention has been developed in light of such circumstances. Therefore, an object of the invention is to suppress an increase in the number of divisions in the train blocks of the layout to simplify the current-flow control system thereof.

Another object of the present invention is to improve operability and convenience for a user by reducing the number of current-flow switching when a train is allowed to run in the layout.

Therefore, in accordance with an aspect of the present invention, the points device for toy railway, including a plurality of outer rails, a plurality of inner rails disposed inside the outer rails, and tongue rails for selectively switching a traveling direction of a train, in which an electrical connection condition of rails is shifted according to a switching direction of the tongue rail, comprises: a first outer rail which is disposed in one side of the points device and extends inwardly from one end of the points device; a second outer rail which is communicated with the first outer rail, which is disposed in the one side and extends inwardly from the other end of the points device, which is located opposite to the one end; a third outer rail which is disposed in the other side of the points device, which is located opposite to the one side and extends inwardly from the one end; a fourth outer rail which is communicated with the third outer rail, which is disposed on the other side and extends inwardly from the other end; and a switch section which is interlocked with the tongue rail, and electrically connects or disconnects the first outer rail with the second outer rail, electrically connects or disconnects a rail which forms a pair with the first outer rail, with a rail which forms a pair with the second outer rail, electrically connects or disconnects the third outer rail with the fourth outer rail, and electrically connects or disconnects a rail which forms a pair with the third outer rail, with a rail which forms a pair with the fourth outer rail, corresponding to the switching direction of the tongue rail.

The points device for toy railway may further comprise four connecting sections connectable with external railways, the connecting sections being double-slip points, two of the connecting sections being disposed at each of the one end and the other end, the four connecting sections comprising: a first connecting section comprising a pair of the first outer rail and the first inner rail provided inside the first outer rail, the first connecting section being provided on the one side at the one end; a second connecting section comprising a pair of the second outer rail and the second inner rail provided inside the second outer rail, the second connecting section being provided on the one side at the other end; a third connecting section comprising a pair of the third outer rail and the third inner rail provided inside the third outer rail, the third connecting section being provided on the other side at the one end; and a fourth connecting section comprising a pair of the fourth outer rail and the fourth inner rail provided inside the fourth outer rail, the fourth connecting section being provided on the other side at the other end, wherein the switch section is interlocked with the tongue rail, and electrically connects either the first outer rail or the third inner rail with the second outer rail, electrically connects either the first inner rail or the third outer rail with the second inner rail, electrically connects either the third inner rail or the first outer rail with the fourth inner rail and electrically connects either the first inner rail or the third outer rail with the fourth outer rail, corresponding to the switching direction of the tongue rail.

The points device for toy railway may further comprise a first gap switch for electrically disconnecting the second outer rail and the second inner rail from other rails which form the double-slip points, irrespective of the switching direction of the tongue rail.

The points device for toy railway may further comprise a second gap switch for electrically disconnecting the fourth outer rail and the fourth inner rail from other rails which form the double-slip points, irrespective of the switching direction of the tongue rail.

The points device for toy railway may further comprise three connecting sections connectable with external railways, one of the three connecting sections being disposed at the one end and the rest two of the three connecting sections being disposed at the other end, the three connecting sections comprising: a first connecting section comprising a pair of the first outer rail and the third outer rail, the first connecting section being provided at the one end; a second connecting section comprising a pair of the second outer rail and the first inner rail provided inside the second outer rail, the second connecting section being provided on the one side at the other end; and a third connecting section comprising a pair of the fourth outer rail and the second inner rail disposed inside the fourth outer rail, the third connecting section being provided on the other side at the other end, wherein the switch section is interlocked with the tongue rail, and electrically connects or disconnects the first inner rail with the third outer rail and electrically connects or disconnects the second inner rail with the first outer rail, corresponding to the switching direction of the tongue rail.

The points device for toy railway may further comprise: a gap switch for electrically disconnecting the fourth outer rail and the second inner rail from other rails irrespective of the switching direction of the tongue rail.

The points device for toy railway may further comprise: a track bed on which the rail is mounted; a backboard which is mounted at a back side of the track bed; and a plurality of wires formed on the backboard and electrically connected with the rails, wherein each of the wires extends toward a region at which the switch section is disposed.

Thus, in the present invention, outer rails which communicate with each other are electrically connected or disconnected and rails comprising pairs with these outer rails are electrically connected or disconnected also corresponding to the switching directions of the tongue rail. Thus, since the electrical connection and disconnection of rails which form the points device is performed by interlocking with the switching of the points device designating the traveling direction of a train, the setting of the current-flow is performed as one function of the points device per se corresponding to the traveling direction of the train. As a result, since the number of divisions of rail sections which are electrically separated can be reduced by the gaps in the layout, the simplification of the current-flow system in the layout may be improved. Together with this, since a user can reduce the frequency of the current-flow switching at each rail block when a train is allowed to run on the layout, operability and convenience may be improved.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

A complete selection system of a points device for toy railway according to the present invention will be explained in detail by exemplifying two embodiments as follows. In the specification, the term "a complete selection system"

means a system to completely shift the conditions of the current-flow to both of a pair of rails which form a track corresponding to the switching directions of a points device.

First Embodiment

Figure 1:
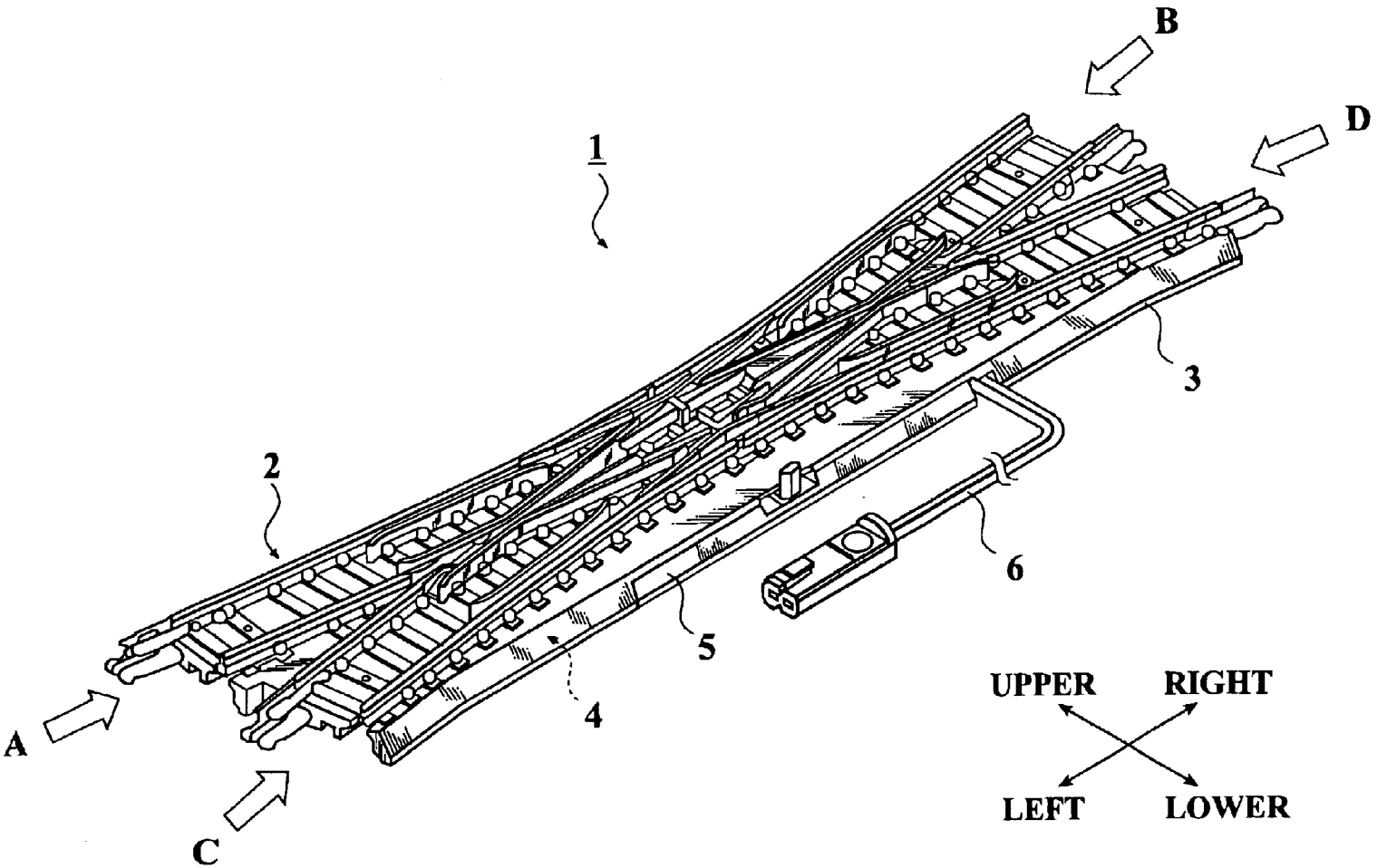
FIG. 1 is a perspective view of the points device according to the first embodiment.

FIG. 1 is a perspective view of a points device for toy railway according to the first embodiment. This points device 1 has a form with tracks intersected in an almost X-shape and is generally called a double-slip points. Points device 1 has four connecting sections "A" to "D" connectable to external lines and the traveling direction of a model train car is set in either crossing directions (A–D, B–C) or slipping directions (A–B, C–D). For the sake of explanation, a connecting section "A" is located in the upper left direction, a connecting section "B" is located in the upper right direction, a connecting section "C" is located in the lower left direction and a connecting section "D" is located in the lower right direction. In the following description, symbols of the members with "a" to "d" denoted thereto essentially mean that the locations of these members correspond to those of connecting sections "A" to "D".

This points device mainly comprises metal-made rails-group 2 containing outer rails, inner rails and the like, plastic-made track bed 3, backboard 4 and drive unit 5 with a built-in electromagnet. Rail 2 is mounted on the surface of track bed 3 and a track comprises a pair of rails 2. Backboard 4 is mounted at the back side of track bed 3 and detachable drive unit 5 is accommodated in an aperture provided on the side of track bed 3. Cord 6 connected with a controlling unit not illustrated is attached to drive unit 5 and a driving current for switching the points device is supplied from the controlling unit side through cord 6.

Figure 2:
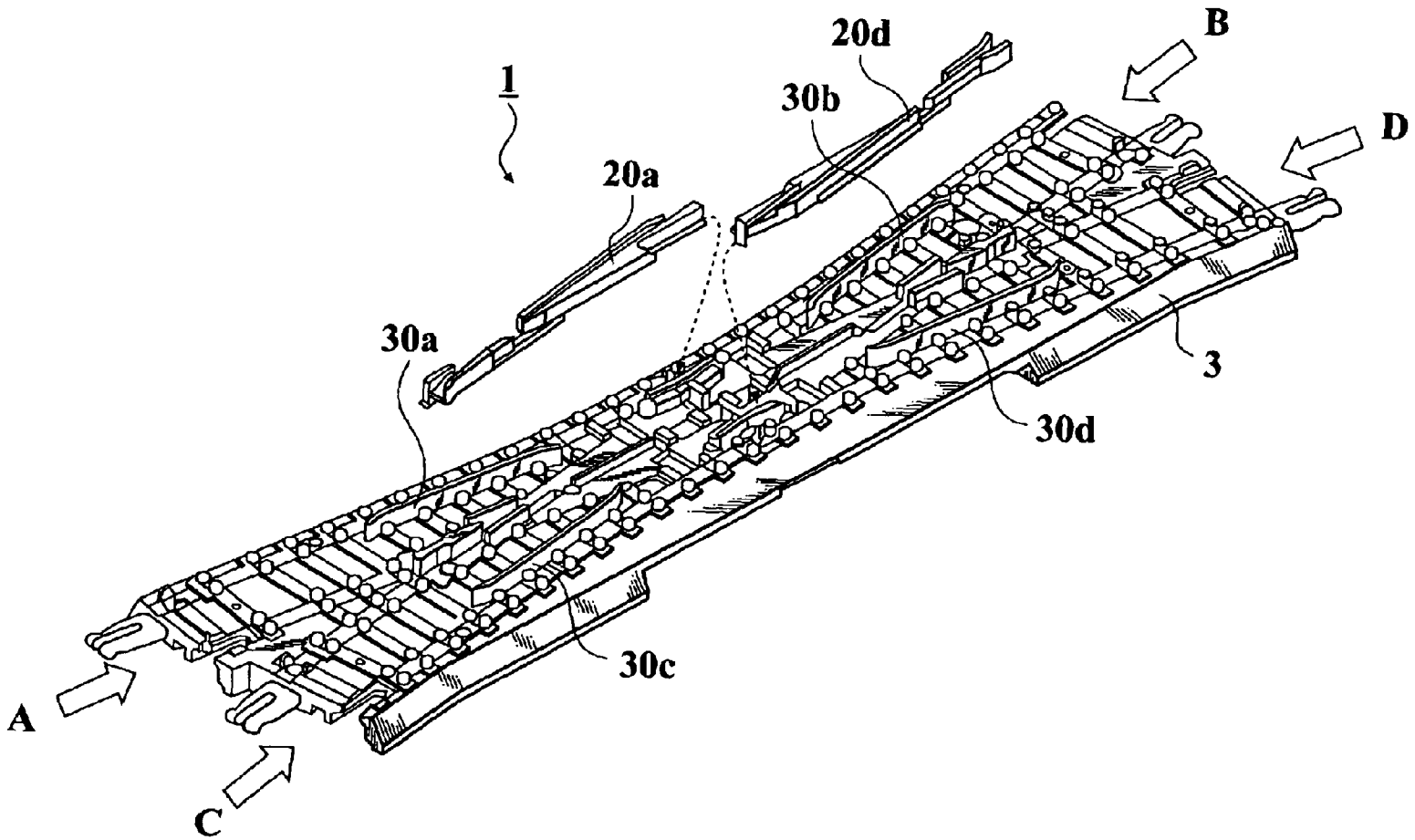
FIG. 2 is a developed perspective view of the points device.

Described is the track constitution of points device 1 in accordance with the developed perspective views as shown in FIG. 2 to FIG. 5. As shown in FIG. 2, guardrails 30*a* to 30*d*, to prevent the derailment of trains, are integrally on track bed 3. A plurality of holes is provided at suitable positions in track bed 3 and is used for various applications such as for a hook of a frog, electric contact with rails, switching tongue rails or formation of a gap switch. A number of sets comprising a pair of nail sections is juxtaposed and formed at mounting regions of rails on the surface of track bed 3. One set of nails protrudes like hooks so as to allow nails to face each other to hook a rail inserted from the surface of track bed 3.

Figure 3:
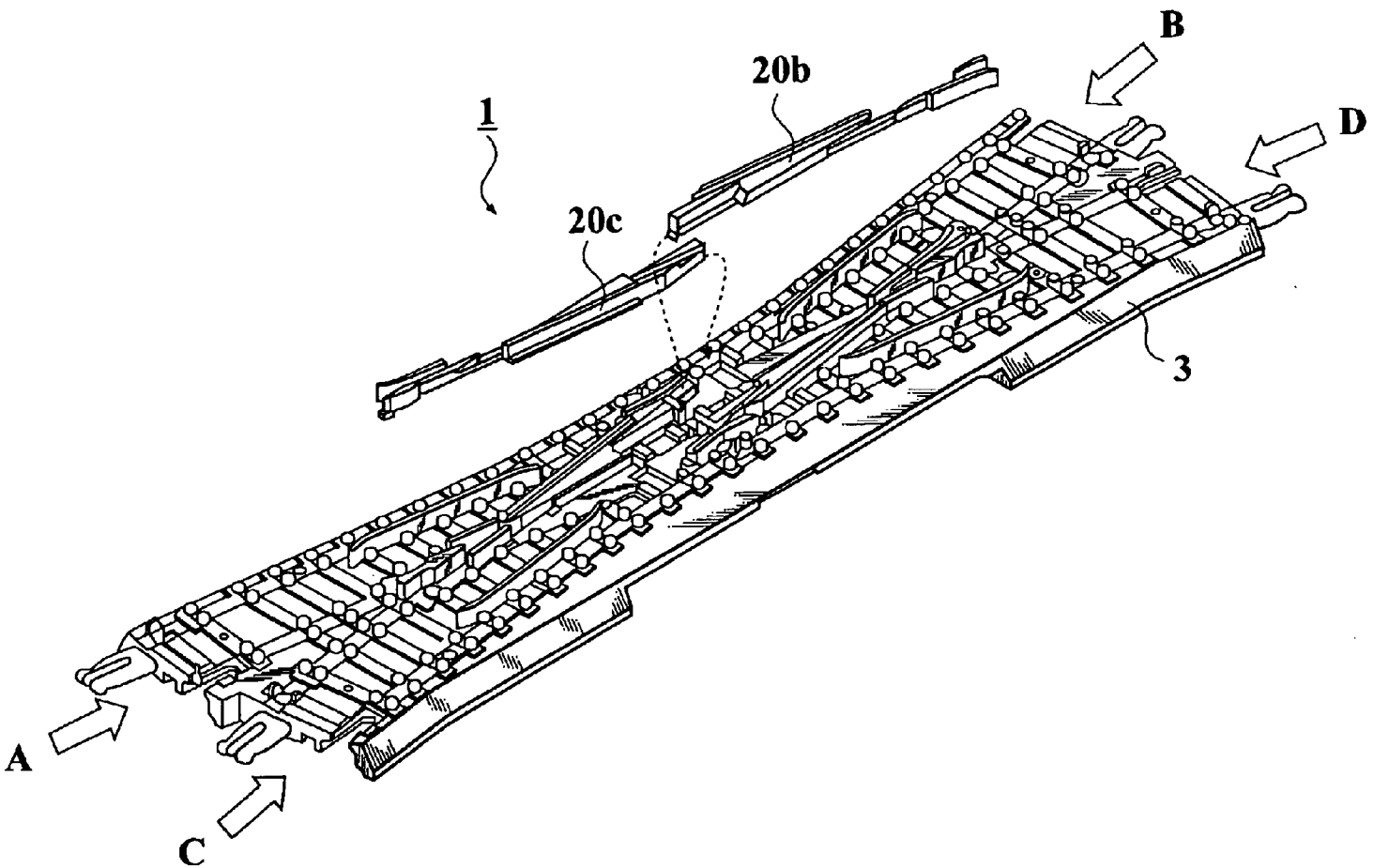
FIG. 3 is a developed perspective view of the points device.
Figure 6:
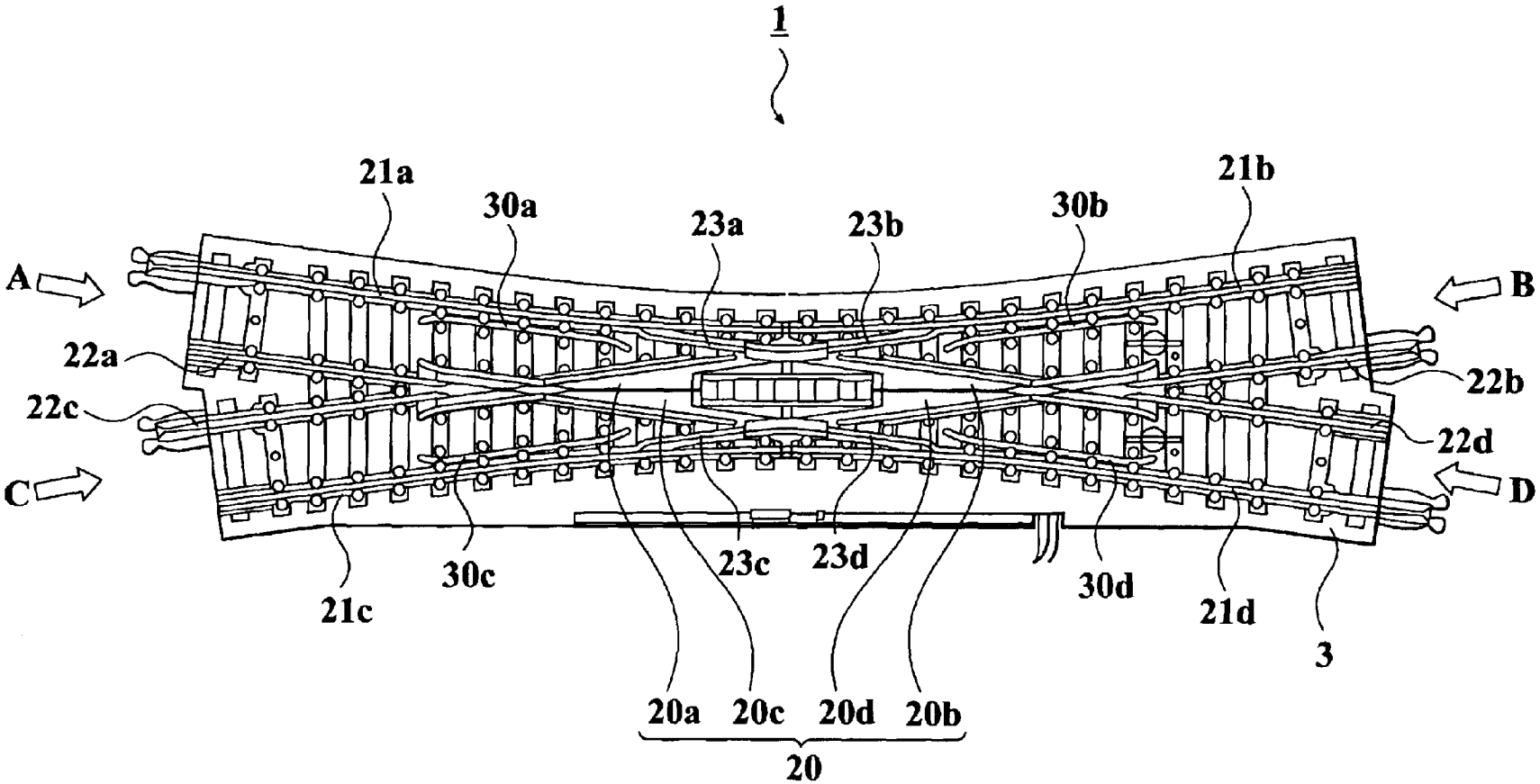
FIG. 6 is a plan view of the points device.

Almost rhombus frog 20 which comprises four frog pieces 20*a* to 20*d* is mounted in the vicinity of the center of track bed 3 where tracks intersect in an X-shape. In particular, as shown in FIG. 2, two frog pieces 20*a*, 20*d* corresponding to the crossing direction of the one (B–C) are so mounted on track bed 3 to be juxtaposed in this crossing direction (B–C). As shown in FIG. 6, a flange way (a groove on which the flange of a wheel passes) of frog piece 20*a* at the upper left communicates with inner rail 22*c* at the lower left, and a flange way of frog piece 20*d* at the lower right communicates with inner rail 22*b* at the upper right. As shown in FIG. 3, two frog pieces 20*b*, 20*c* corresponding to the other crossing direction (A–D) are so mounted on track bed 3 as to be juxtaposed in this crossing direction (A–D) and as to intersect with frog pieces 20*a*, 20*d* previously mounted. As shown in FIG. 6, a flange way of frog piece 20*c* at the lower left communicates with inner rail 22*a*at the lower left, and a flange way of frog piece 20*b* at the upper right communicates with inner rail 22*d* at the lower right. Since four frog pieces 20*a* to 20*d* are so disposed as not to contact with each other, a current can individually and independently flow in each of them. Almost rhombus frog 20 as shown in FIG. 6 is constituted by combining these frog pieces 20*a* to 20*d*.

Figure 4:
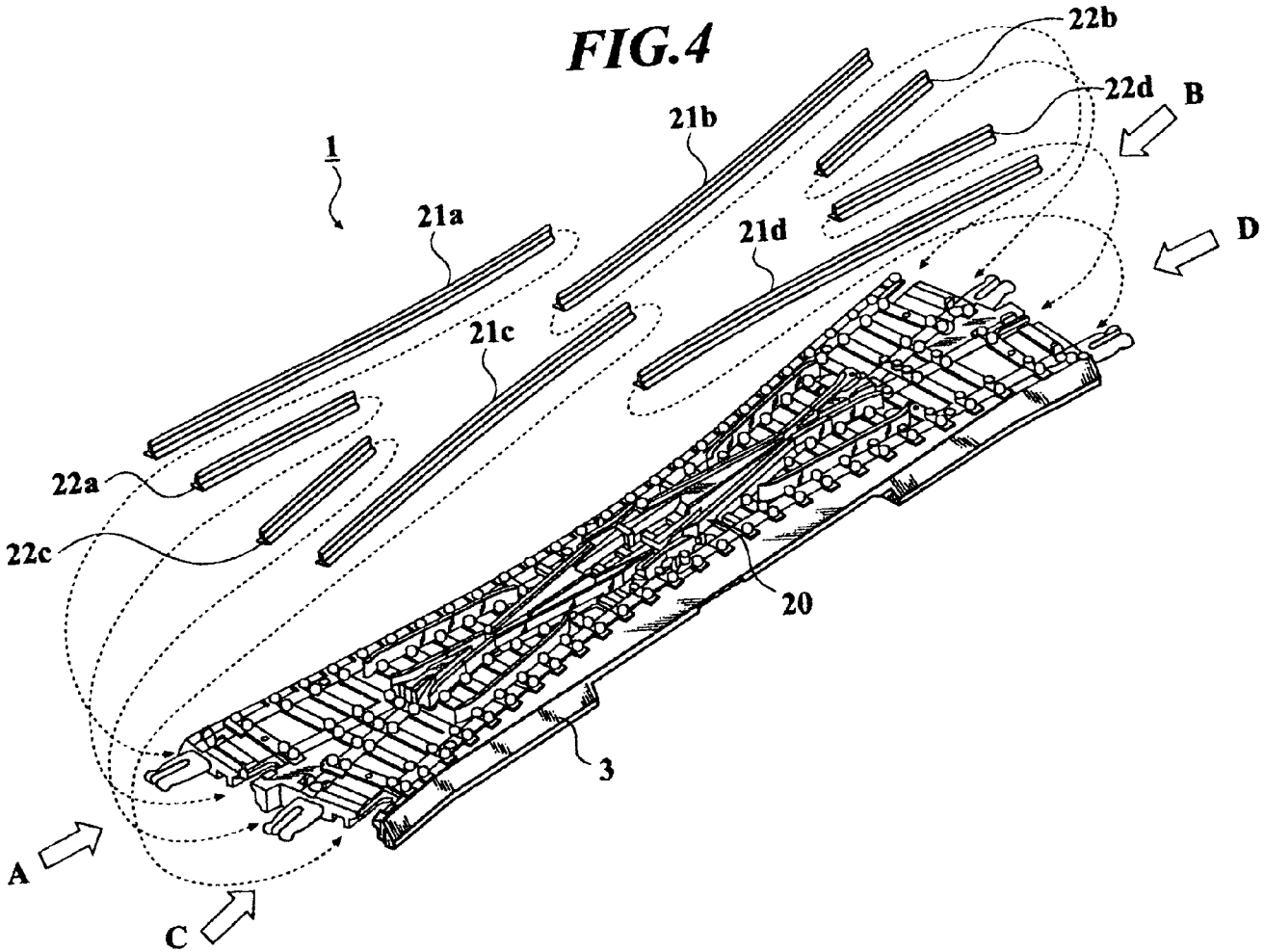
FIG. 4 is a developed perspective view of the points device.

As shown in FIG. 4, two outer rails 21*a*, 21*b* are mounted in the vicinity of the upper side of track bed 3. Outer rail 21*a* at the upper left extends while it is curved like an arc inwardly from connecting section "A" at the upper left, and outer rail 21*b* at the upper right extends while it is curved like an arc inwardly from connecting section "B" at the upper right. The inside tips of these outer rails 21*a*, 21*b* do not contact with each other and face each other with slightly spaced relationship, thereby two outer rails 21*a*, 21*b* extending from the right to the left at the upper side communicate each other with the rails mutually insulated (the rails are gapped). On the other hand, two outer rails 21*c*, 21*d* are mounted in the vicinity of the lower side of track bed 3. Outer rail 21*c* at the lower left extends while it is curved like an arc inwardly from connecting section "C" at the lower left and outer rail 21*d* at the lower right extends while it is curved like an arc inwardly from connecting section "D" at the lower right. The inside tips of these outer rails 21*c*, 21*d* do not contact with each other and face each other with slightly spaced relationship, thereby two outer rails 21*c*, 21*d* extending from the right to the left at the lower side communicate each other with the rails mutually insulated (the rails are gapped). The rail layout of points device 1 according to the embodiment features that the pairs of outer rails which communicate each other (21*a*, 21*b* or 21*c*, 21*d*) are gapped.

On the other hand, inner rails 22*a* to 22*d* are mounted inside outer rails 21*a* to 21*d* on track bed 3 and extend in parallel with outer rails 21*a* to 21*d* locationally corresponding thereto. Inner rail 22*a* at the upper left extends inwardly from connecting section "A" at the upper left, forming a pair with outer rail 21*a* outside thereof to form a track. Inner rail 22*b* at the upper right extends inwardly from connecting section "B" at the upper right, forming a pair with outer rail 21*b* outside thereof to form a track. Inner rail 22*c* at the lower left extends inwardly from connecting section "C" at the lower left, forming a pair with outer rail 21*c* outside thereof to form a track. Inner rail 22*d* at the lower right extends inwardly from connecting section "D" at the lower right, forming a pair with outer rail 21*d* outside thereof to form a track.

Figure 5:
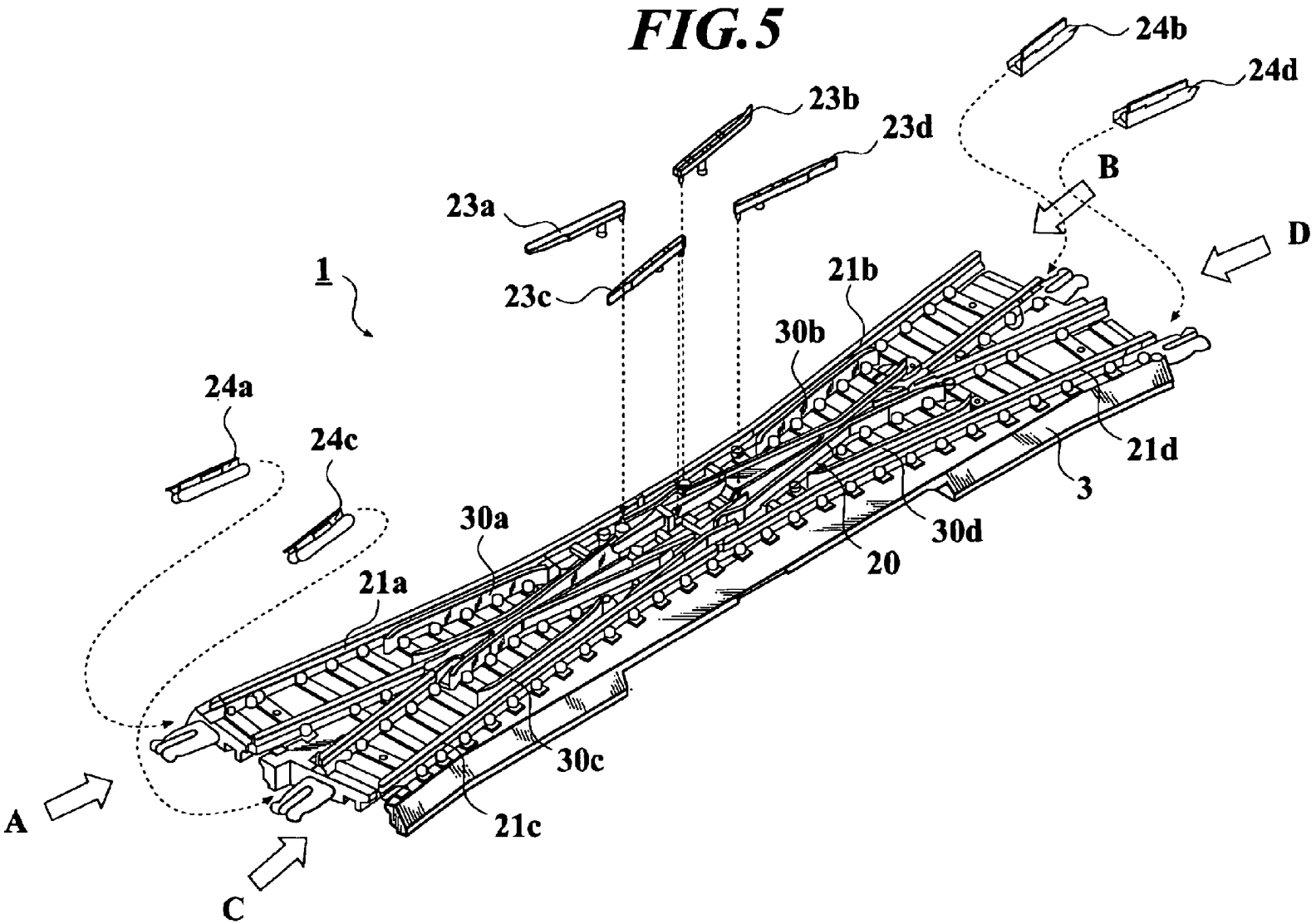
FIG. 5 is a developed perspective view of the points device.

As shown in FIG. 5, tongue rails 23*a* to 23*d*, to selectively set the running track of a train, are mounted at four positions of the upper left, upper right, lower left and lower right in the vicinity of the center of track bed 3. Tongue rail 23*a* at the upper left extends from the upper vertex of almost rhombus frog 20 to the left and tongue rail 23*b* at the upper right extends from the upper vertex of frog 20 to the right. Tongue rail 23*c* at the lower left extends from the lower vertex of frog 20 to the left and tongue rail 23*d* at the lower right extends from the lower vertex of frog 20 to the right. Each of tongue rails 23*a* to 23*d* is rotatable around the center of the rotation axis provided on the roots, all tongue rails are uniformly operated by the linking mechanism later described and are set to the same switching direction. However, the rotation is restricted to the range from a position (a crossing direction) where the tips of tongue rails 23*a* to 23*d* contact with outer rails 21*a* to 21*d* to a position (a slipping direction) where their tips contact with guardrails 30*a* to 30*d*.

The conditions of the current-flow of tongue rails 23*a* to 23*d* are determined corresponding to the contacting tips. When the tips are in contact with outer rails 21*a* to 21*d*, the conditions of the current-flow of tongue rails 23*a* to 23*d* are the same as in outer rails 21*a* to 21*d* since an electric power is supplied from outer rails 21*a* to 21*d* to tongue rails 23*a* to 23*d*. On the other hand, when the tips are in contact with guardrails 30*a* to 30*d*, an electric power is not supplied to tongue rails 23*a* to 23*d* and these tongue rails are insulated from other rails since guardrails 30*a* to 30*d* is made of plastics same as track bed 3. Joints 24*a* to 24*d* are mounted on connecting sections "A" to "D" equivalent to track ends of points device 1, and points device 1 is electrically connected with external rails by the joints.

Described is the position relation between outer rails 21*a* to 21*d* and inner rails 22*a* to 22*d* referring to the plan view, as shown in FIG. 6. Each of outer rails 21*a* to 21*d* is disposed at the nearest position to the side points device 1. In particular, outer rail 21*a* positioned at the upper side of points device 1 extends inwardly from the left end (connecting section "A") of points device 1. Similarly, outer rail 21*b* at the upper side thereof extends inwardly from the right end (connecting section "B") of points device 1. Although these outer rails 21*a*, 21*b* extend communicating with each other at the upper side of points device 1, they are mutually insulated so as to allow a current to flow in each rail by separate systems. On the other hand, outer rail 21*c* positioned at the lower side of points device 1 extends inwardly from the left end (connecting section "C") of points device 1. Similarly, outer rail 21*d* positioned at the lower side extends inwardly from the right end (connecting section "D") of points device 1. Although these outer rails 21*c*, 21*d* extend communicating with each other at the lower side of points device 1, they are mutually insulated so as to allow a current to flow in each rail by separate systems.

On the other hand, inner rails 22*a* to 22*d* are mounted inside outer rails 21*a* to 21*d* forming a pair with outer rails 21*a* to 21*d* locationally corresponding-thereto to form a track. In particular, inner rail 22*a* which forms a pair with outer rail 21*a* at the upper left to form a track extends inwardly from connecting section "A" at the upper left. Inner rail 22*b* which forms a pair with outer rail 21*b* at the upper right extends inwardly from connecting section "B" at the upper right. Inner rail 22*c* which forms a pair with outer rail 21*c* at the lower left extends inwardly from connecting section "C" at the lower left and inner rail 22*d* which forms a pair with outer rail 21*d* at the lower right extends inwardly from connecting section "D" at the lower right.

Figure 7A:
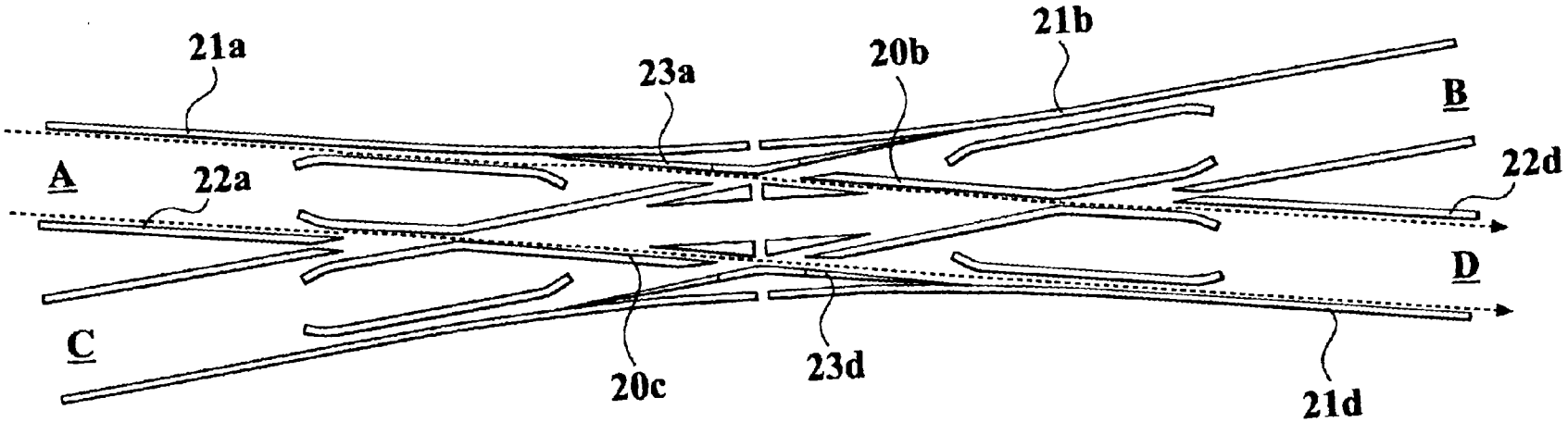
FIG. 7A is an explanatory view of running tracks corresponding to the switching directions of the points device set to a crossing direction.

The running track of a train on points device 1 is set corresponding to the switching direction (a crossing direction or a slipping direction) of points device 1. FIG. 7A is an explanatory view of the running track corresponding to the switching direction of points device 1 set to a crossing direction. Since all tongue rails 23*a* to 23*d* contact with outer rails 21*a* to 21*d*, a running track linking connecting section "A" at the upper left and connecting section "D" at the lower right is formed, and a running track linking connecting C at the lower left and connecting section "D" at the upper right is formed. For example, for a running track (illustrated in a dotted line) linking connecting sections (A–D), outer rail 21*a* of connecting section "A" communicates with inner rail 22*d* of connecting section "D" through tongue rail 23*a* at the upper left contacting with outer rail 21*a* and a flange way of frog piece 20*b* at the upper right. Inner rail 22*a* connecting section "A" communicates with outer rail 21*d* of connecting section "D" through a flange way of frog piece 20*c* at the lower left and tongue rail 23*d* at the lower right contacting with outer rail 21*d*.

Figure 7B:
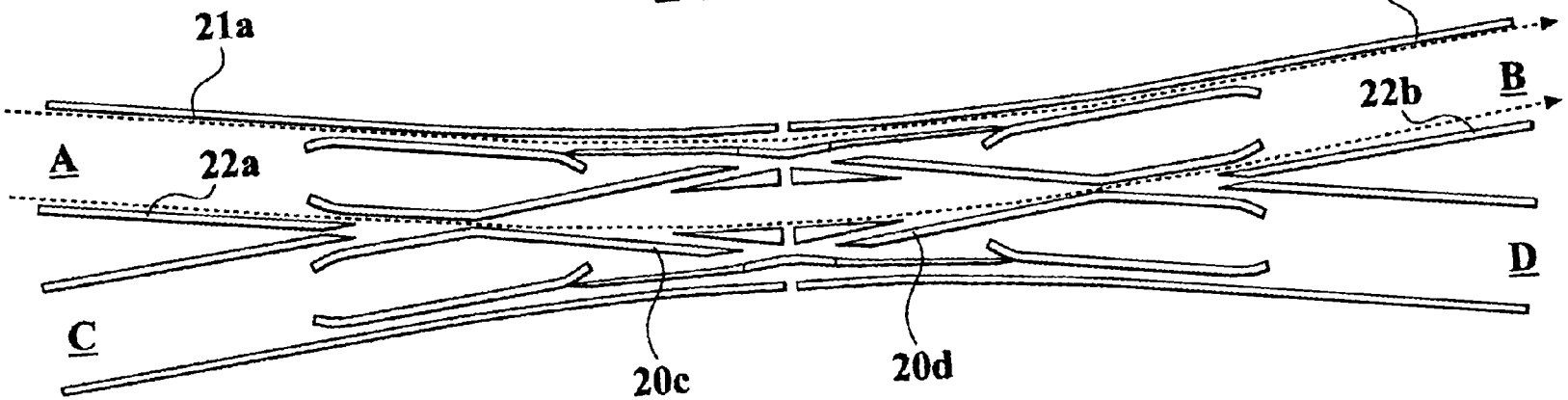
FIG. 7B is an explanatory view of running tracks corresponding to the switching directions of the points device set to a slipping direction.

FIG. 7B is an explanatory view of the running track corresponding to the switching direction of points device set to a slipping direction. Since tongue rails 23*a* to 23*d* and outer rails 21*a* to 21*d* are spaced out, a running track linking connecting section "A" at the upper left and connecting section "B" at the upper right is formed, and a running track linking connecting section "C" at the lower left and connecting section "D" at the lower right is formed. For example, for a running track (illustrated in a dotted line) linking connecting sections (A–B), since outer rail 21*a* of connecting section "A" and tongue rail 23*a* at the upper left are spaced out, outer rail 21*a* communicates with outer rail 21*b* of connecting section "B". Inner rail 22*a* communicates with inner rail 22*b* of connecting section "B" through a flange way of frog piece 20*c* at the lower left and a flange way of frog piece 20*d*.at the lower right.

Described is the inner structure of track bed 3 referring to the developed perspective view as shown in FIGS. 8 to 11. A linking mechanism switching tongue rails 23*a* to 23*d*, a current-flow mechanism applying an electric power to rails interlocking with this linking mechanism, and a gear switch mechanism are provided inside track bed 3.

Figure 8:
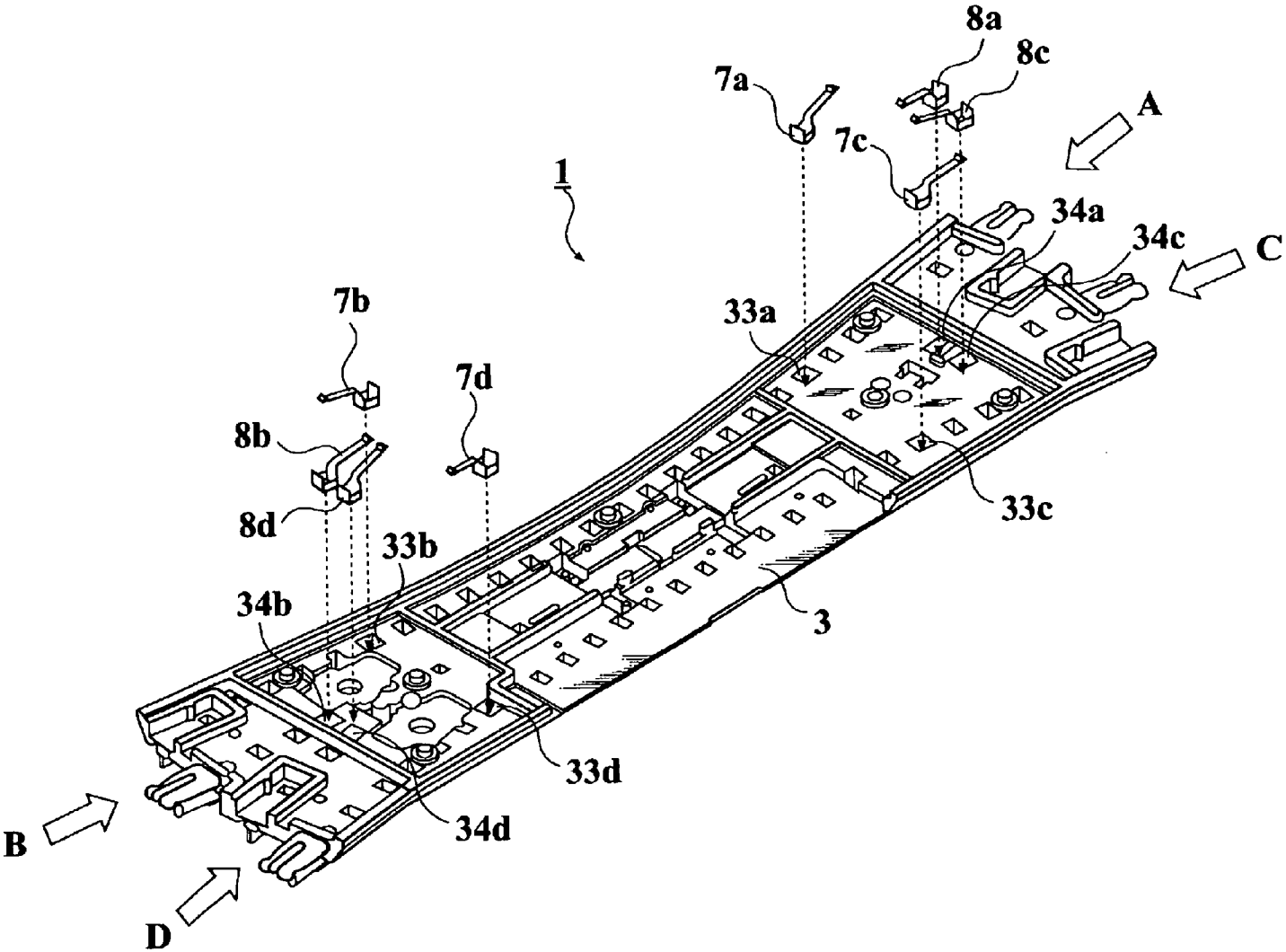
FIG. 8 is a developed perspective view of the inside of the track bed of the points device.

As shown in FIG. 8, contacts 7*a* to 7*d* are inserted into contact holes 33*a* to 33*d* which penetrate the front side through back side of track bed 3, and contacts 8*a* to 8*d* are inserted into contact holes 34*a* to 34*d* which penetrate the front side through back side of track bed 3. These contacts 7*a* to 7*d*, 8*a* to 8*d* are conductive members which are metal sheets each bent like a scoop having a square head and an arm extendingfrom the head at a slant. Four contact holes 33*a* to 33*d* are provided at each mounting region of four outer rails 21*a* to 21*d*, and outer rails 21*a* to 21*d* are exposed at the back of track bed 3 through these holes 33*a* to 33*d*. Outer rails to 21*a* to 21*d* and contacts 7*a* to 7*d* corresponding thereto are electrically connected by fitting the heads of contacts 7*a* to 7*d* into these holes 7*a* to 7*d* from the back side of track bed 3.

Four contact holes 34*a* to 34*d* are provided at each mounting region of four inner rails 22*a* to 22*d* and inner rails 22*a* to 22*d* are exposed at the back side of track bed 3 from these holes 34*a* to 34*d*. Inner rails 22*a* to 22*d* and contacts 8*a* to8*d* corresponding thereto are electrically connected fitting the heads of contacts 8*a* to 8*d* into these holes 34*a* to 34*d* from the back side of track bed 3. the arm sections of contacts 7*a* to 7*d* and 8*a* to 8*d* are electrically connected with a wiring pattern formed on backboard 4 later described.

Figure 9:
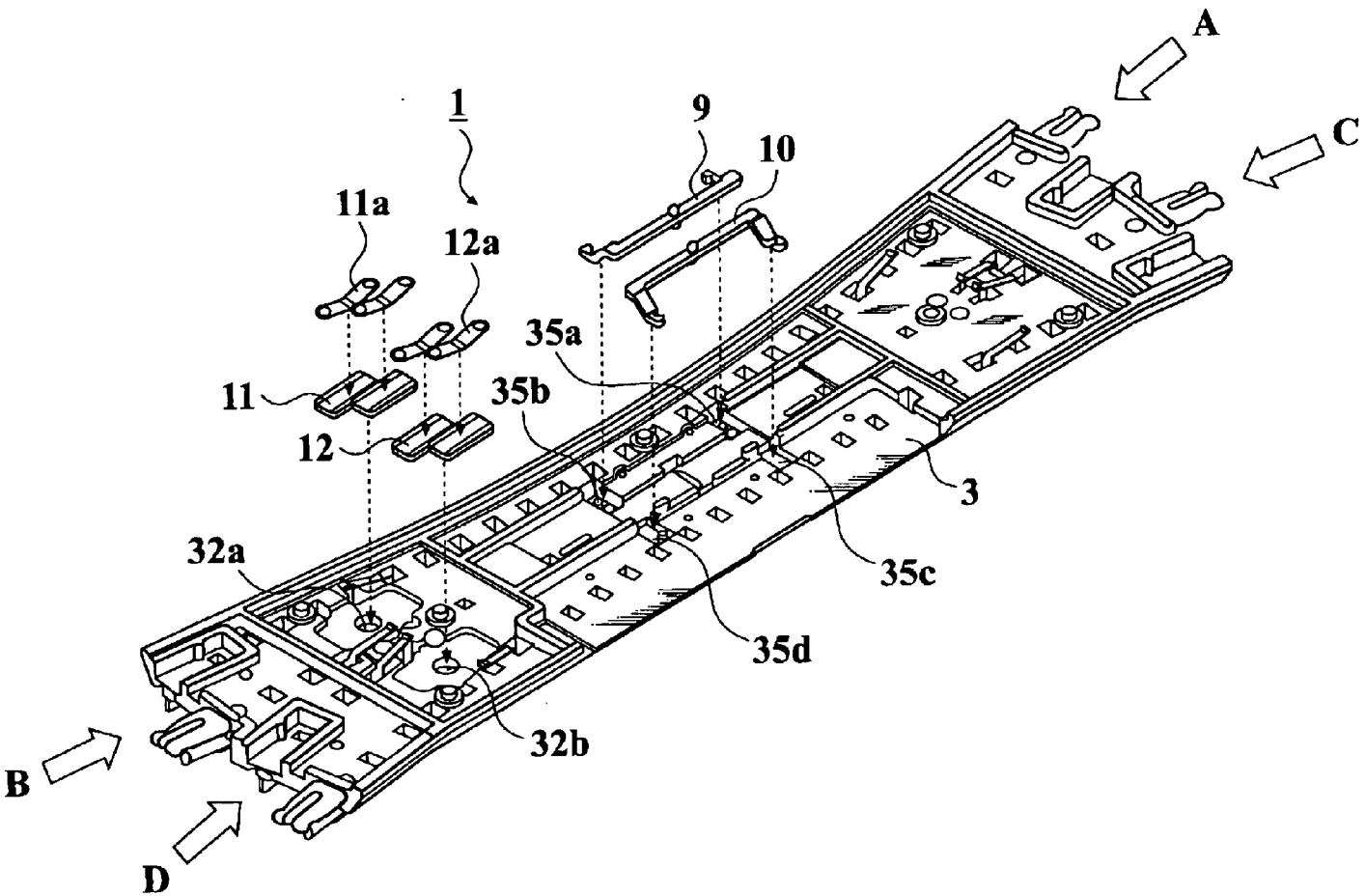
FIG. 9 is a developed perspective view of the inside of the track bed of the points device.
Figure 10:
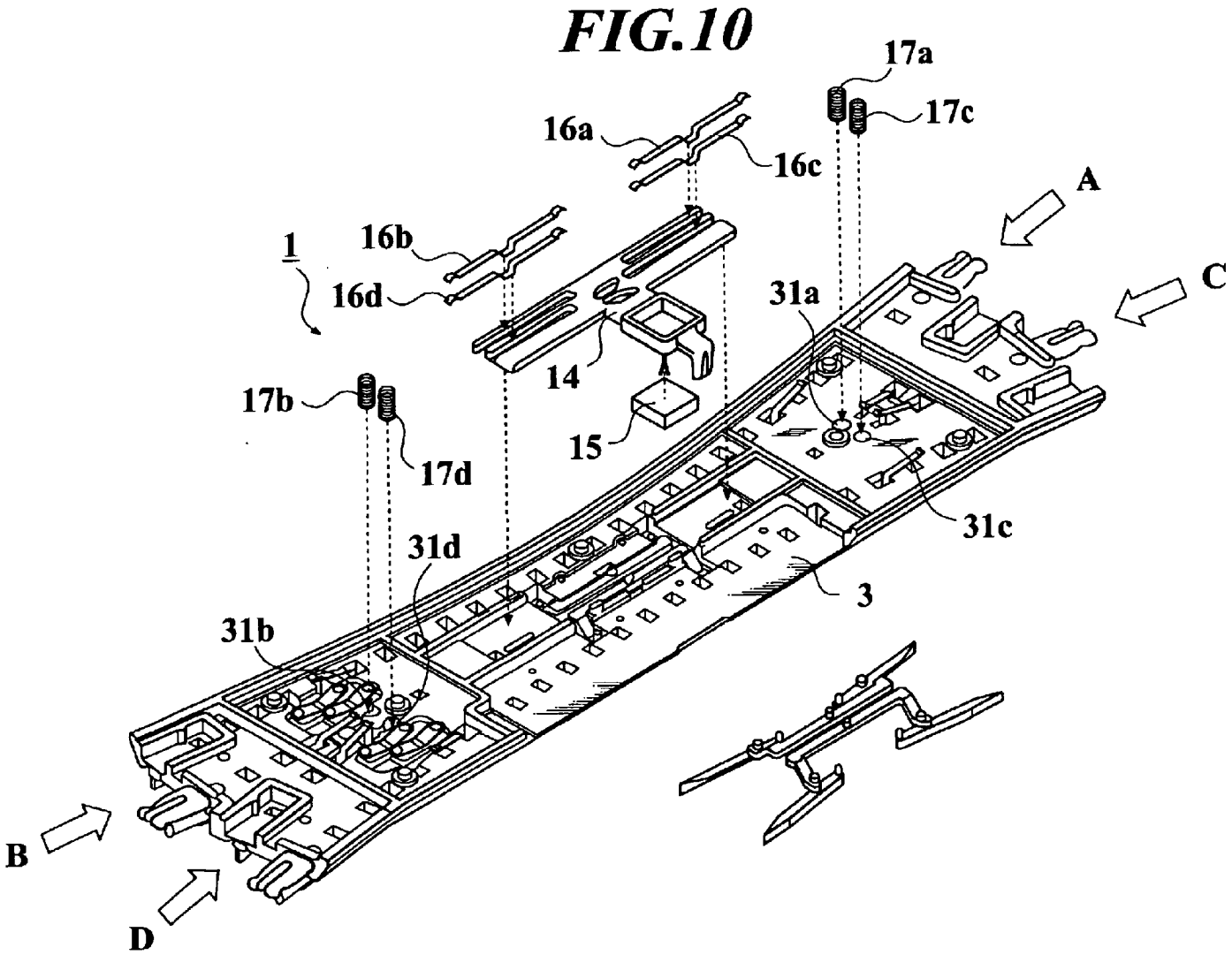
FIG. 10 is a developed perspective view of the inside of the track bed of the points device.

As shown in FIG. 9, a pair of drive arms 9, 10 comprising a part of the link mechanism and displaceable in the width direction of points device 1 are mounted at the back side of track bed 3. Each of drive arms 9, 10 is bent in an almost arc shape and a protrusion provided at the center is engaged with a guide hole provided on the side of guide body 14 comprising a part of the linking mechanism as shown in FIG. 10. The nails provided at both ends of drive arms 9, 10 are engaged with the protrusions on the side of tongue rails 23*a* to 23*d* inserted into holes 35*a* to 35*d*. In particular, one end of drive arm 9 is engaged with tongue rail 23*a* at the upper left and the other end of drive arm 9 is engaged with tongue rail 23*b* at the upper right. One end of drive arm 10 is engaged with tongue rail 23*c* at the lower left and the other end of drive arm 10 is engaged with tongue rail 23*d* at the lower right.

A gap switch mechanism selectively insulates a pair of rails equivalent to connecting sections "B", "D" where a gap may be set from other rails comprising points device 1. This mechanism comprises a pair of switch bodies 11, 12 and a pair of gap bellows 11*a*, 12*a* mounted thereon. With switch bodies 11, 12 fitted into holes 32*a*, 32*b*, the heads of switch bodies 11, 12 face the surface of track bed 3, on top of which is provided with a groove into which a minus driver may be inserted. The connecting conditions of gap bellows 11*a*, 12*a* in a wiring pattern later described may be shifted by rotating switch bodies 11, 12 with a minus driver to shift the existence or nonexistence of gap setting.

As shown in FIG. 10, guide body 14 also functioning as the switch section integrally formed with switch contacts 16*a* to 16*d* is provided with a permanent magnet 15. With an electromagnetic action generated between this permanent-magnet 15 and the magnet 15 drive unit side, guide body 14 is displaced in the longitudinal direction (the right and leftdirections) of the points device and switch contacts 16*a* to 16*d* are also displaced in the longitudinal directions. With switch contacts 16*a* to 16*d* displaced, the connecting conditions between wires constituting a wiring pattern are shifted. A pair of guide holes of an almost parallelogram is provided at the center of guide body 14 which is axisymmetric across the longitudinal line of points device 1. These guide holes are engaged with the protrusions provided at the centers of drive units 9, 10 and a displacement, in the longitudinal direction of guide body 14 is converted to the width directions of drive arms 9, 10. When guidebody 14 is displaced in the longitudinal direction, tongue rails 23*a* to 23*d* are rotated since the protrusions on drive arms 9, 10 slide on the oblique sides of the guide holes to allow drive arms 9, 10 to be displaced. Thus, tongue rails 23*a* to 23*d* are shifted by the linking mechanism corresponding to the displacement of points device 1 and a current-flow switching is also performed by the current-flow mechanism interlocking therewith.

Springs 17*a* to 17*d* are each inserted into four frog piece holes 31*a* to 31*d* penetrating the front side through the back side of track bed 3 and these holes 31*a* to 31*d* are provided at each mounting region of four frog pieces 20*a* to 20*d*. Frog pieces 20*a* to 20*d* and springs 17*a* to 17*d* locationally corresponding thereto are electrically connected by inserting springs 17*a* to 17*d* into frog piece holes 31*a* to 31*d* from the back side of track bed 3. The lower sections of springs 17*a* to 17*d* are electrically connected with the wiring constituting the wiring pattern.

Figure 11:
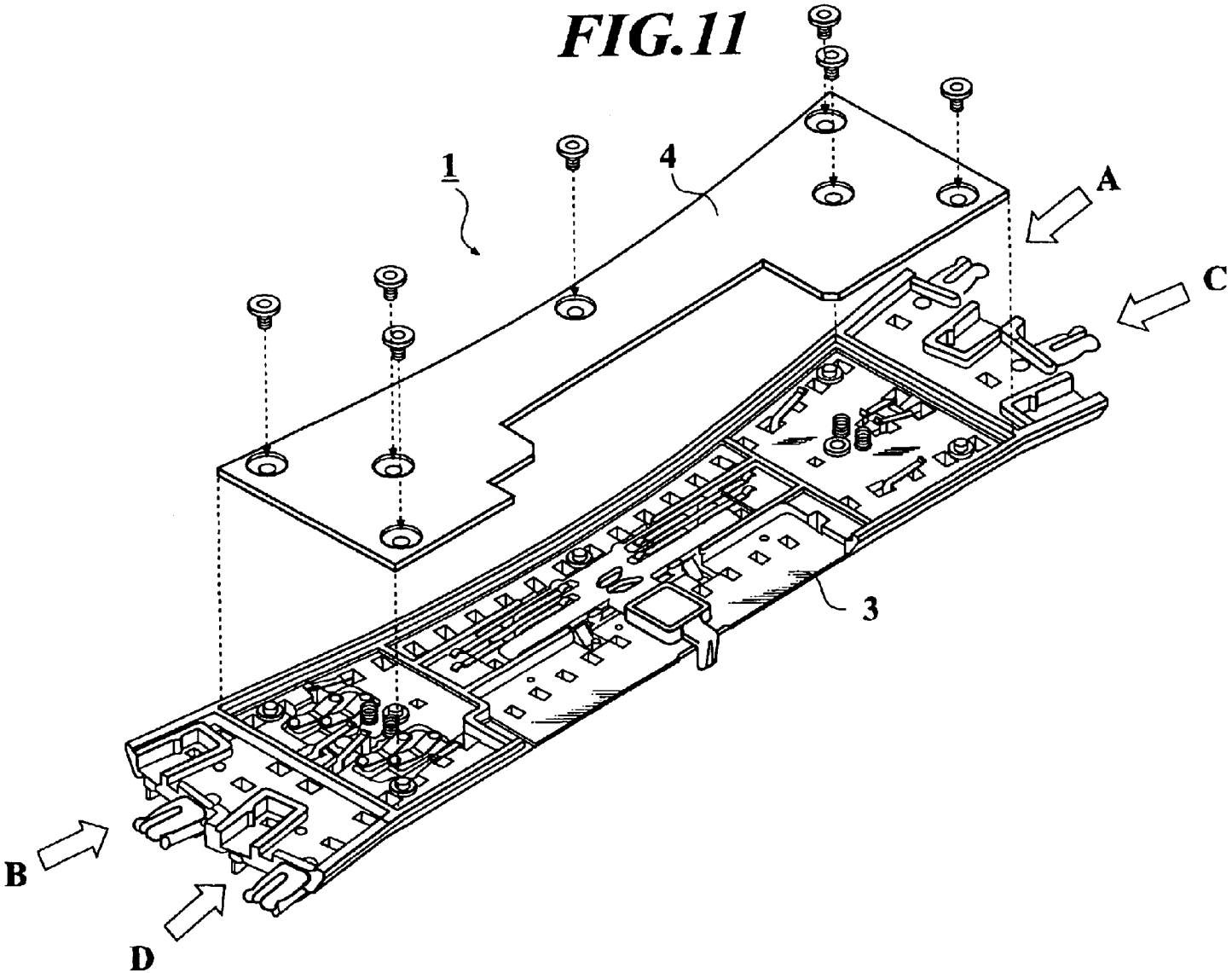
FIG. 11 is a developed perspective view of the inside of the track bed of the points device.
Figure 12:
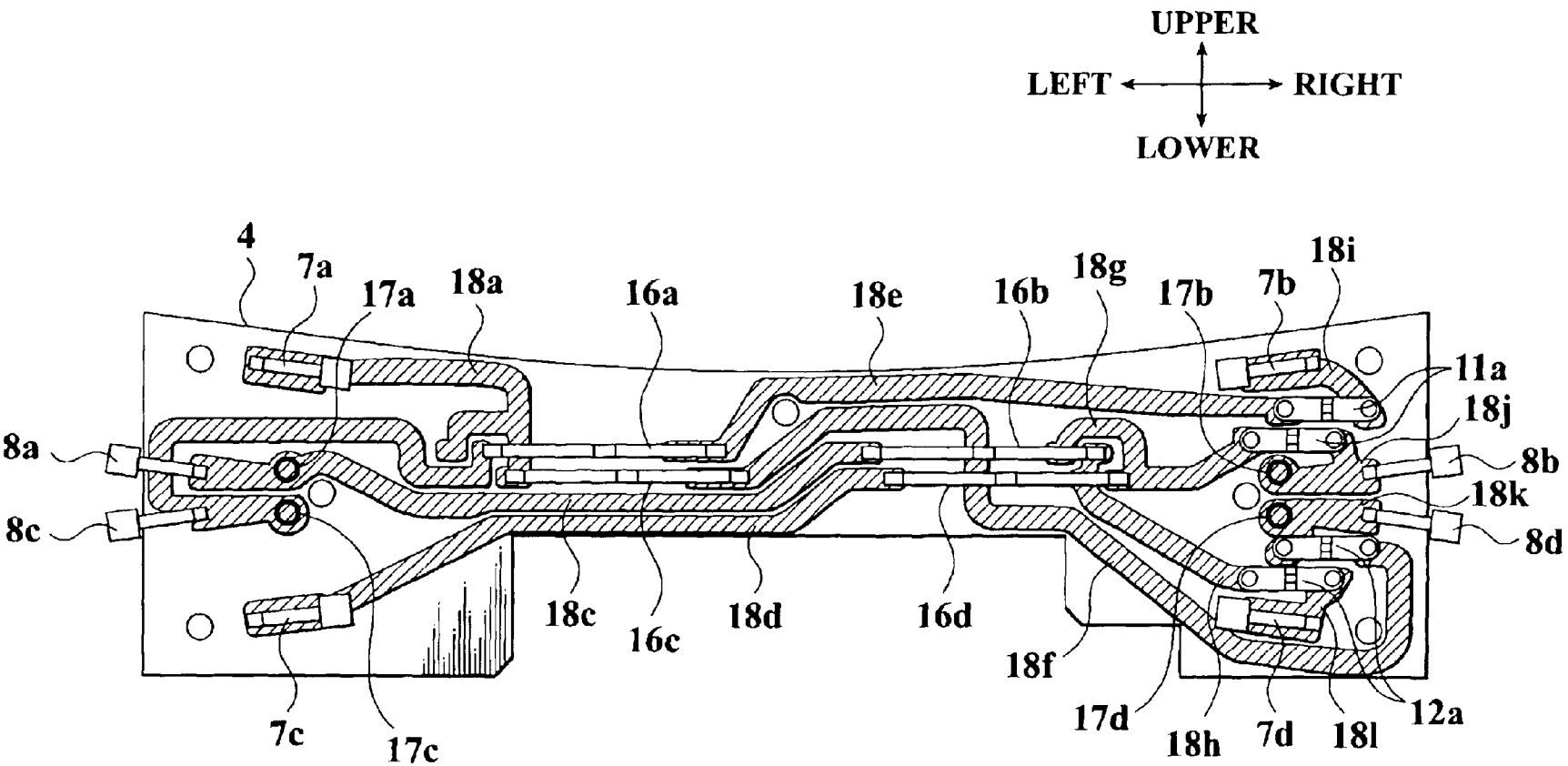
FIG. 12 is an explanatory view of the current-flow mechanism including a wiring pattern.

As shown in FIG. 11, backboard 4 is mounted at the back side of track bed 3 with screws. A wiring pattern constituting a plurality of wires is provided on one side of backboard 4. FIG. 12 is an explanatory view of the current-flow mechanism including the wiring pattern formed on backboard 4, wherein the areas shown in oblique lines are equivalent to wiring and a plurality of wires 18*a* to 18*l* are disposed in a proper layout. These wires 18*a* to 18*l* extend toward a region where a switch is disposed, that is, where switch contacts 16*a* to 16*d* are mounted.

Contacts 7*a* to 7*d*, 8*a* to 8*d* and springs 17*a* to 17*d*, electrically connected with rails, are electrically connected with either of wires 18*a* to 18*d*. In particular, outer rail 21*a* at the upper left is connected with wire 18*a* by contact 7*a* and outer rail 21*b* at the upper right is connected with wire 18*i* by contact 7*b*. Outer rail 21*c* at the lower left is connected with wire 18*d* by contact 7*c* and outer rail 21*d* at the lower right is connected with wire 18*l* by contact 7*d*. Inner rail 22*a* at the upper left is connected with wire 18*c* by contact 8*a* and inner rail 22*b* at the upper right is connected with wire 18*j* by contact 8*b*. Inner rail 22*c* at the lower left is connected with wire 18*b* by contact 8*c*. Inner rail 22*d* at the lower right is connected with wire 18*k* by contact 8*d*. Further, frog piece 20*a* at the upper left is connected with wire 18*c* by spring 17*a* and frog piece 20*b* at the upper right is connected with wire 18*j* by spring 17*b*. Frog piece 20*c* at the lower left is connected with wire 18*b* by spring 17*c* and frog piece 20*d* at the lower right is connected with wire 18*k* by spring 17*d*

Connections between wires in the wiring pattern are shifted by allowing a pair of gap bellows 11*a*, 12*a* mutually interlocked to be displaced in a rotation direction. With one gap bellow 11*a* rotated, wire 18*e* and wire 18*i* are connected or disconnected, and wire 18*g* and wire 18*j* are connected or disconnected. When these wires 18*g*, 18*j* are disconnected, a pair of rails 21*b*, 22*b* comprising the track of connecting section "B" are insulated from other rails in points device 1. With the other gap bellow 12*a* rotated, wire 18*f* and wire 18*k* are connected or disconnected, and wire 18*h* and wire 181 are connected or disconnected. When these wires 18*f*, 18*k* are disconnected, a pair of rails 21*d*, 22*d* comprising the track of connecting section "D" are insulated from other rails in points device 1.

Figure 13:
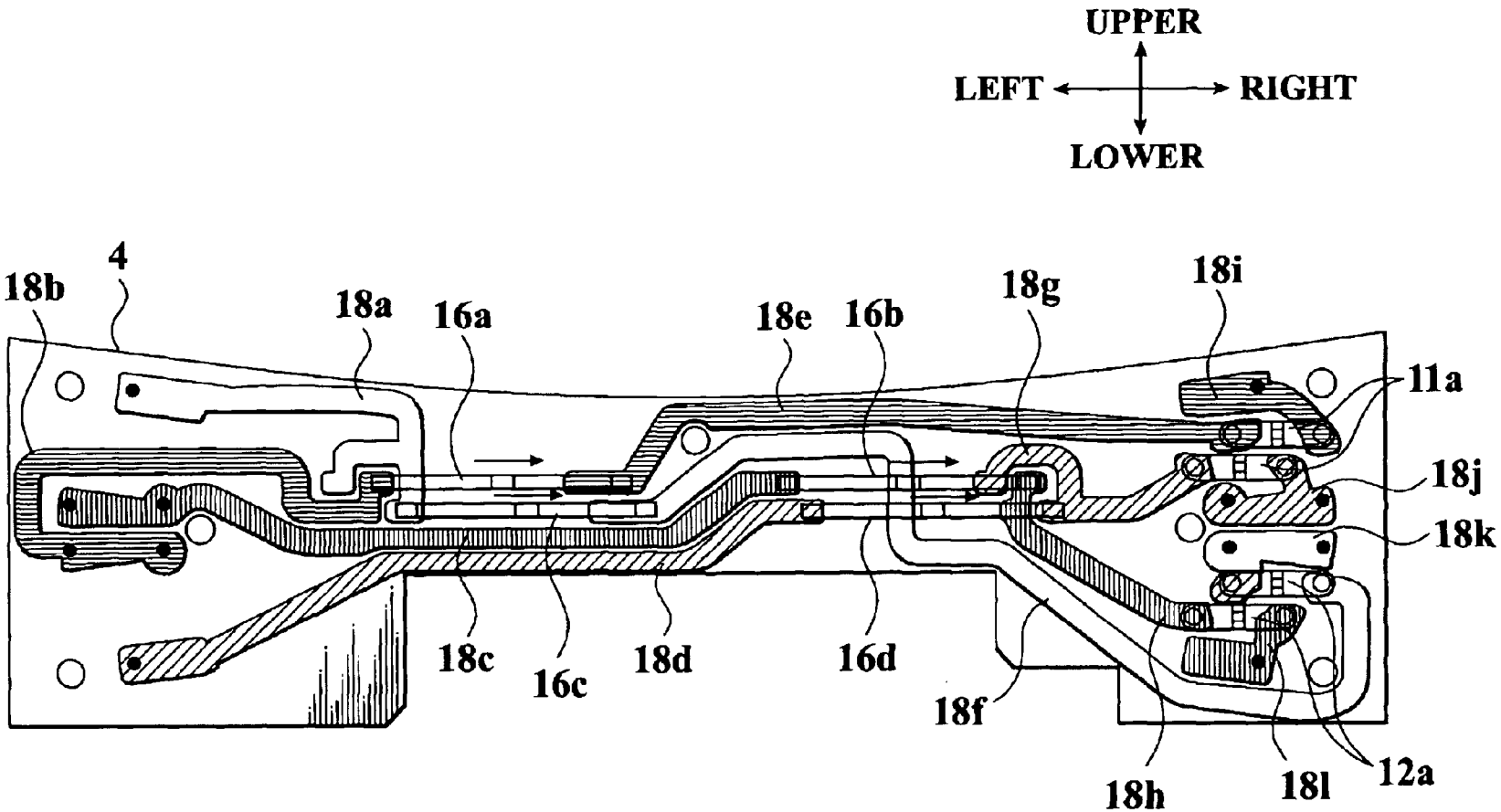
FIG. 13 is an explanatory view of wiring connection when the switch contacts are moved to the right.

Connections between wires in the wiring pattern are also shifted by allowing four switch contacts 16*a* to 16*d* mutually interlocked to be displaced in the longitudinal direction (the right and left directions) of points device 1. FIG. 13 is an explanatory view of wire connections when switch contacts 16*a* to 16*d* are displaced in the right direction. The black points indicated in FIG. 13 are equivalent to the regions at which the switch contacts are in contact with rails and the like (also the same as in FIG. 14). In this case, since wire 18*b* and wire 18*e* are connected by switch contact 16*a*, current paths 18*b*, 18*e*, 18*i* illustrated in transverse lines are formed. Since wire 18*c* and wire 18*h* are connected by switch contact 16*b*, current paths 18*c*, 18*h*, 181 illustrated in vertical lines are formed. Since wire 18*a* and wire 18*f* are connected by switch contact 16*c*, current paths 18*a*, 18*f*, 18*k* illustrated in plain framework are formed. Since wire 18*d* and wire 18*g* are connected by switch contact 16*d*, current paths 18*d*, 18*g*, 18*j* illustrated in oblique lines are formed.

Figure 14:
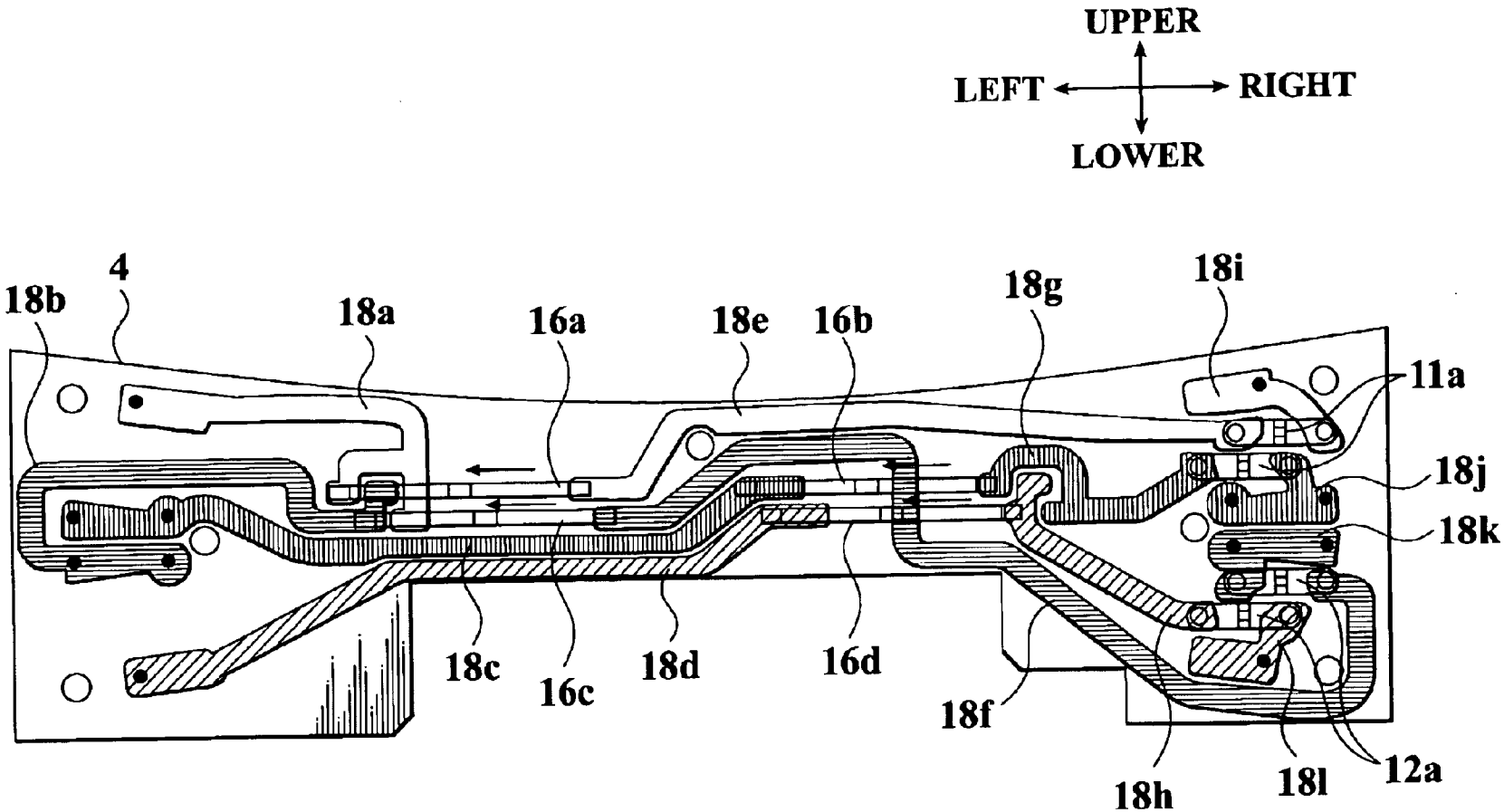
FIG. 14 is an explanatory view of wiring connection when the switch contacts are moved to the left.

FIG. 14 is an explanatory view of wire connections when switch contacts 16*a* to 16*d* are displaced in the left direction. In this case, since wire 18*a* and wire 18*e* are connected by switch contact 16*a*, current paths 18*a*, 18*e*, 18*i* illustrated in a plain framework only are formed. Since wire 18*c* and wire 18*g* are connected by switch contact 16*b*, current paths 18*c*, 18*g*, 18*j* illustrated in vertical lines are formed. Since wire 18*b* and wire 18*f* are connected by switch contact 16*c*, current paths 18*b*, 18*f*, 18*k* illustrated in transverse lines are formed. Since wire 18*d* and wire 18*h* are connected by switch contact 16*d*, current paths 18*d*, 18*h*, 181 illustrated in oblique lines are formed.

Figure 15:
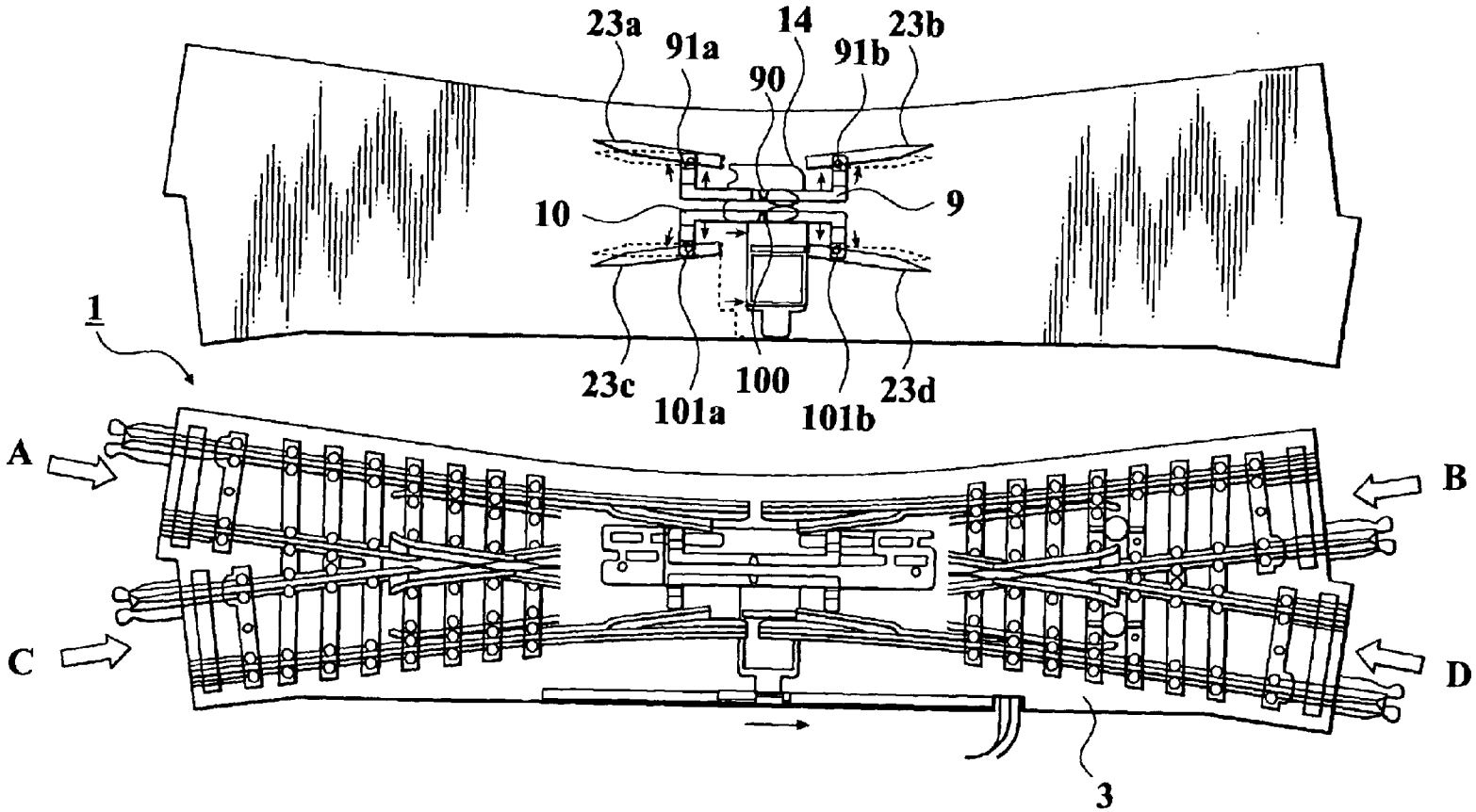
FIG. 15 is an explanatory view of switching of a tongue rail in a crossing direction.

Described is the interlocking relation between the linking mechanism mentioned above and the current-flow mechanism. FIG. 15 is an explanatory view of switching of tongue rails 23*a* to 23*d* in a crossing direction. When points device 1 is set to a crossing direction, a driving current in a positive direction is supplied to drive unit 5. By applying the current, an electromagnet in drive unit 5 generates an electromagnetic force, by whose electromagnetic action, guide body 14 mounted on permanent magnet 15 is displaced to the right. Protrusion 90 of drive arm 9 engaged with a guide hole on the upper side is pushed up along the left oblique side of the guide hole which is displaced to the right, thereby the protrusions on the sides of tongue rails 23*a*, 23*b* engaged with both ends 91*a*, 91*b* of drive arm 9 are also pushed up. As a result, tongue rail 23*a* at the upper left is rotated clockwise to allow the tip thereof to contact with outer rail 21*a* at the upper left, and tongue rail 23*b* at the upper right is rotated counterclockwise to allow the tip thereof to contact with outer rail 21*b* at the upper right.

Protrusion 100 of drive arm 10 engaged with a guide hole on the lower side is pushed up along the left oblique side of the guide hole which is displaced to the right, thereby the protrusions on the sides of tongue rails 23*c*, 23d engaged with both ends 101*a*, 101*b* of drive arm 10 are also pushed up. As a result, tongue rail 23*c* at the lower left is rotated counterclockwise to allow the tip thereof to contact with outer rail 21*c* at the lower left, and tongue rail 23*d* at the lower right is rotated clockwise to allow the tip thereof to contact with outer rail 21*d* at the lower right.

Figure 17:
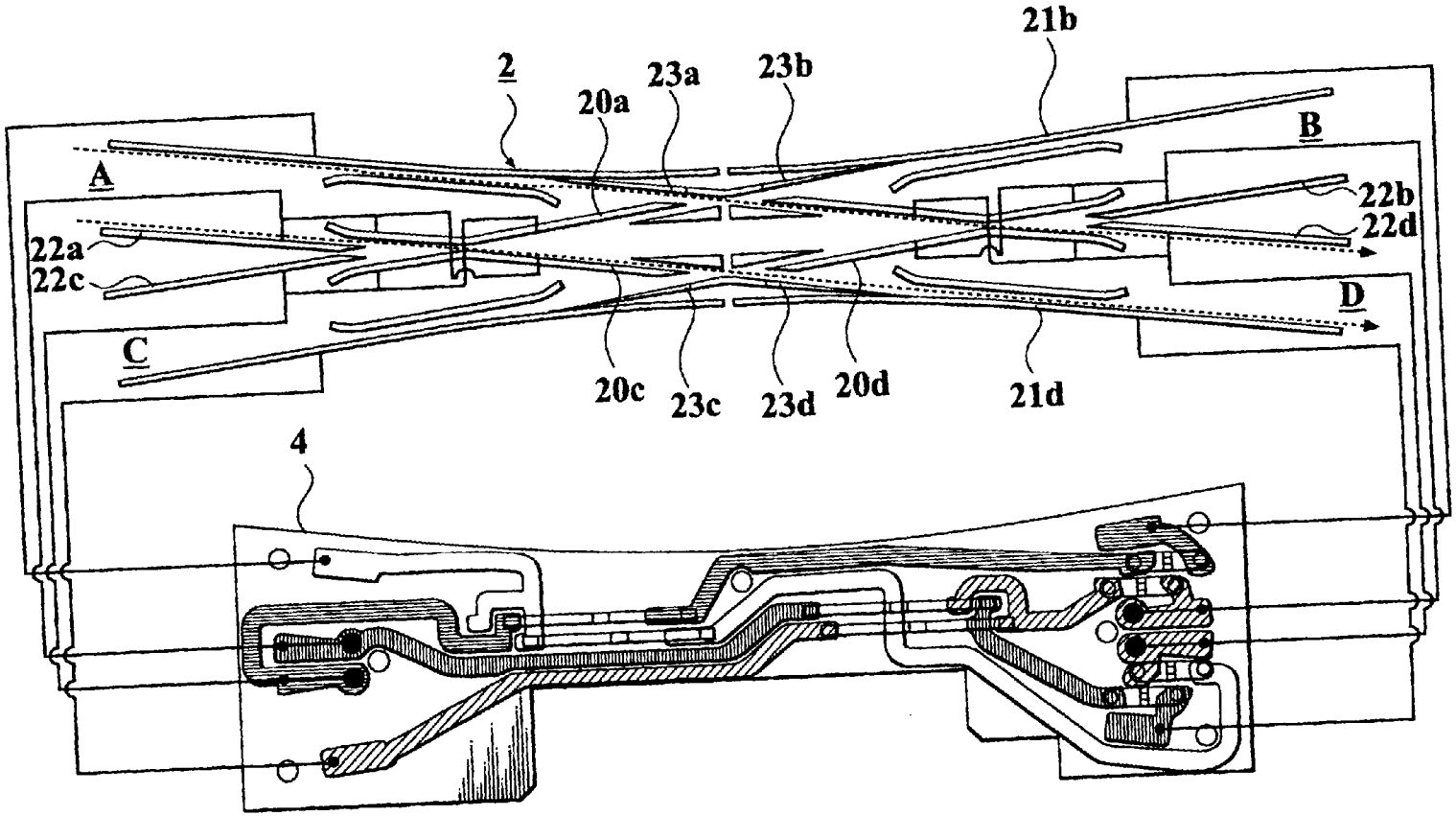
FIG. 17 is an explanatory view of the condition of the current-flow to rails in a crossing direction.

FIG. 17 is a view showing the conditions of the current-flow to rails in a crossing direction. When setting is performed to a crossing direction, rails which communicate in a crossing direction are so connected as to be in the same conditions of the current-flow including the polarities of rails. As for tracks in the crossing directions (A–D), a current of one polarity flows in one group of rails 21*a*, 23*a*, 20*b*, 22*d*. This is because outer rail 21*a* at the upper left, frog piece 20*b* at the upper right and inner rail 22*d* at the lower right are electrically connected through the current path illustrated in a plain framework in backboard 4, and tongue rail 23*a* at the upper left is in contact with outer rail 21*a* at the upper left. In addition, as for this track, a current of the opposite polarity flows in the other group of rails 22*a*, 20*c*, 23*d*, 21*d*. This is because inner rail 22*a* at the upper left, frog piece 20*c* at the lower left and outer rail 21*d* at the lower right are electrically connected through the current path illustrated in vertical lines in backboard 4, and tongue rail 23*d* at the lower right is in contact with outer rail 21*d* at the lower right.

On the other hand, as for the track in the crossing direction (B–C), a current of one polarity flows in one group of rails 22*c*, 20*a*, 23*b*, 21*b*. This is because inner rail 22*c* at the lower left, frog piece 20*a* at the upper left and outer rail 21*b* at the upper right are electrically connected through the current path illustrated in transverse lines in backboard 4, and tongue rail 23*b* at the upper right is in contact with outer rail 21*b* at the upper right. In addition, as for this track, a current of the opposite polarity flows in the other group of rails 21*c*, 23*c*, 20*d*, 22*b*. This is because outer rail 21*c* at the lower left, frog piece 20*d* at the lower right and inner rail 22*b* at the upper right are electrically connected through the current paths illustrated in oblique lines in backboard 4, and tongue rail 23*c* at the lower left is in contact with outer rail 21*c* at the lower left.

Figure 16:
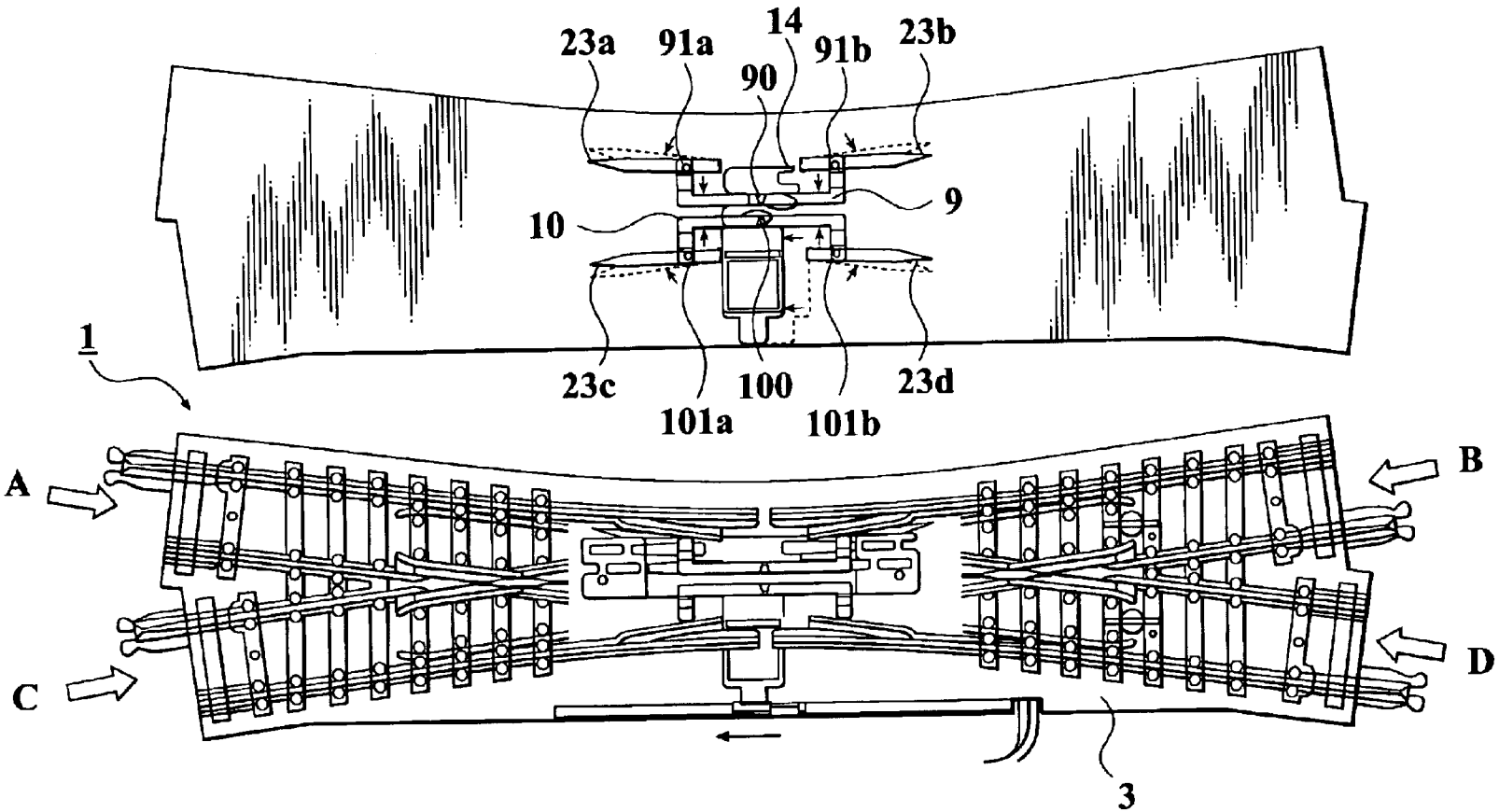
FIG. 16 is an explanatory view of switching of a tongue rail in a slipping direction.

FIG. 16 is an explanatory view of switching of tongue rails 23*a* to 23*d* in a slipping direction. When points device 1 is set to a slipping direction, a driving current in the opposite-direction is supplied to drive unit 5, thereby guide body 14 is displaced to the left with an electromagnetic force generated from drive unit 5. Protrusion 90 of drive arm 9 engaged with the guide hole on the upper side is pushed down along the right oblique side of the guide hole which is displaced to the left, thereby the protrusions on the side of tongue rails 23*a*, 23*b* engaged with both ends 91*a*, 91*b* of drive arm 9 are also pushed down. As a result, tongue rail 23*a* is rotated counterclockwise to allow the tip thereof to be spaced out from outer rail 21*a* at the upper left, and tongue rail 23*b* at the upper right is rotated clockwise to allow the tip thereof to be spaced out from outer rail 21*b* at the upper right. On the other hand, protrusion 100 of drive arm 10 engaged with the guide hole at the lower side is pushed up along the right oblique side of this guide hole, thereby the protrusions on the side of tongue rails 23*c*, 23*d* engaged with both ends 101*a*, 101*b* of drive arm 10 is also pushed up. As a result, tongue rail 23*c* at the lower left is rotated clockwise to allow the tip thereof to be spaced out from outer rail 21*c* at the lower left, and tongue rail 23*d* at the lower right is rotated counterclockwise to allow the tip thereof to be spaced out from outer rail 21*d* at the lower right.

Figure 18:
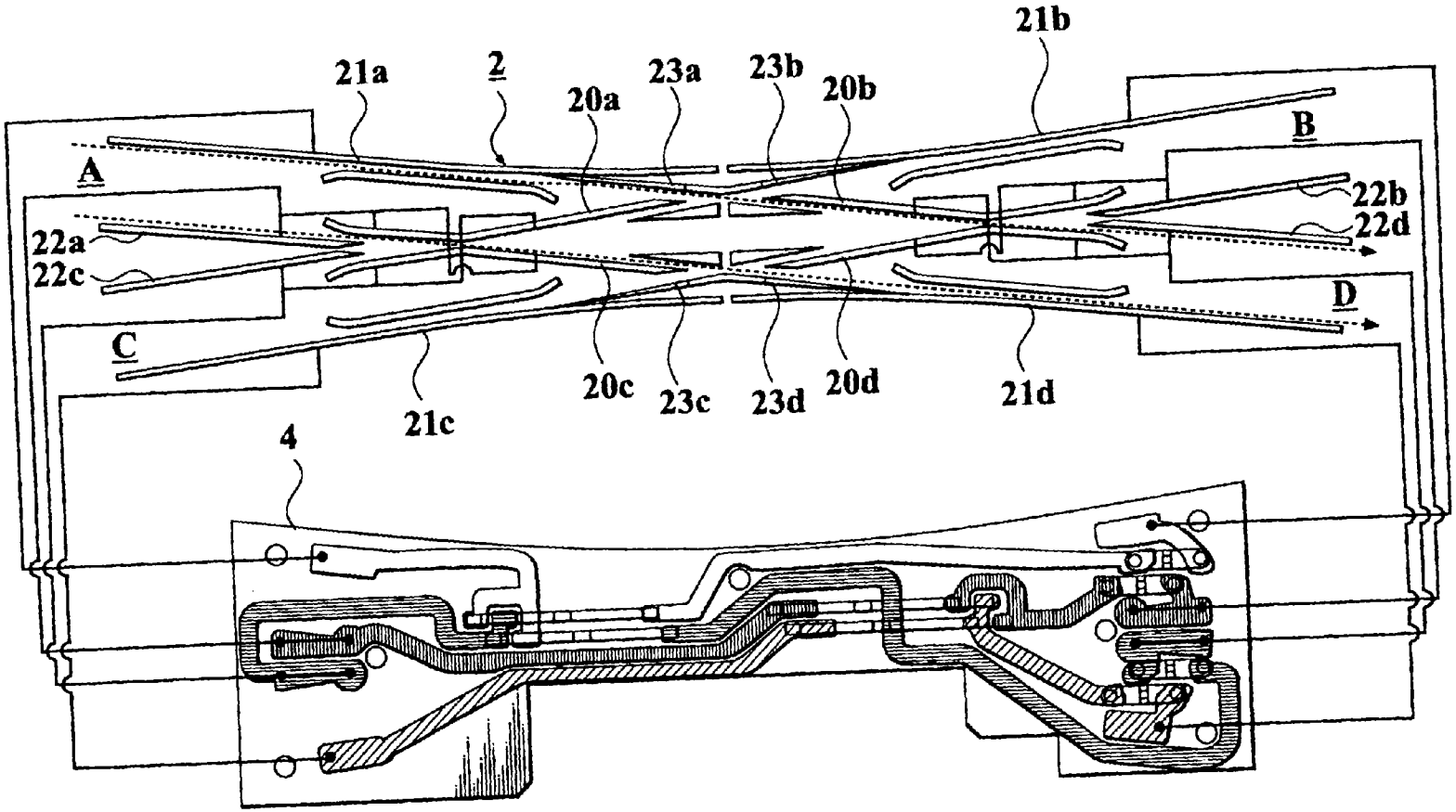
FIG. 18 is an explanatory view of the condition of the current-flow to rails in a slipping direction.

FIG. 18 is an explanatory view showing the conditions of the current-flow to rails in a slipping direction. When setting is performed in a slipping direction, rails which communicate in a slipping direction are so connected as to be in the same conditions of the current-flow including the polarities of rails. As for tracks in the slipping directions (A–B), a current of one polarity flows in one group of rails 21*a*, 21*b*. This is because outer rail 21*a* at the upper left and outer rail 21*b* at the upper right are electrically connected through the current path illustratedin a plain framework in backboard 4. In addition, as for this track, a current of the opposite polarity flows in the other group of rails 22*a*, 20*c*, 20*d*, 22*b*. This is because inner rail 22*a* at the upper left, frog piece 20*c* at the lower left, frog piece 20*d* at the lower right and inner rail 22*b* at the upper right are electrically connected through the current path illustrated in vertical lines in backboard 4.

On the other hand, as for the track in the slipping direction (C–D), a current of one polarity flows in one group of rails 22*c*, 20*a* 20*b*, 22*d*. This is because inner rail 22*c* at the lower left, frog piece 20*a* at the upper left, frog piece 20*b* at the upper right and inner rail 22*d* at the lower right are electrically connected through the current path illustrated in striping in backboard 4. In addition, as for this track, a current of the opposite polarity flows in the other group of rails 21*c*, 21*d*. This is because outer rail 21*c* at the lower left and outer rail 21*d* at the lower right are electrically connected through the current path illustrated in oblique lines in backboard 4.

.

Thus, electrical connection or disconnection between rails comprising points device 1 is performed interlocking with tongue rails 23*a* to 23*d* and is selectively set corresponding to the switching direction of a tongue rail. When a track in a crossing direction is formed, outer rail 21*a* at the upper left and outer rail 21*b* at the upper right are electrically disconnected, and outer rail 21*c* at the lower left and outer rail 21*d* at the lower right are electrically disconnected. When a track in a slipping direction is formed, outer rail 21*a* at the upper left and outer rail 21*b* at the upper right are electrically connected, and outer rail 21*c* at the lower left and outer rail 21*d* at the lower right are electrically connected. More particularly, outer rail 21*a* at the upper left is electrically connected with either of outer rail 21*b* at the upper right or inner rail 22*d* at the lower right. Inner rail 22*a* at the upper left which forms a pair with this outer rail 21*a* is electrically connected with either inner rail 22*b* at the upper right or outer rail 21*d* at the lower right. Outer rail 21*c* at the lower left is electrically connected with either outer rail 21*d* at the lower right or inner rail 22*b* at the upper right. Inner rail 22*c* at the lower left which forms a pair with this outer rail 21*c* is electrically connected with either inner rail 22*d* at the lower right or outer rail 21*b* at the upper right. As is clear from the foregoing, the current-flow system of this points device 1 is a complete selection system where the conditions of the current-flow to both of a pair of rails comprising a track are completely shifted corresponding to the switching direction of the points device. With points device 1 of such complete selection system, the conditions of the current-flow to both of a pair of rails comprising a track can be shifted corresponding to the switching direction of points device 1. That is, with this points device 1, the current-flow setting of a rail on the positive polarity side and the current-flow setting of a rail on the negative polarity side are performed, matching with the running track of a train on points device 1. In this system, the current-flow setting corresponding to the traveling direction of a train can be performed by merely switching points device 1, and it is unnecessary to individually shift the current-flow. If a layout is formed utilizing a points device 1 of such complete selection system, it can suppress an increase in the number of divisions of line sections where the control of the current-flow is individually performed. As a result, it has an advantage that the current-flow control system of a layout can be simplified even in a complicated layout. Moreover, it can offer an improved operability and convenience to the user since the operation times of the current-flow switching can be reduced when a train is allowed to run by the number of reduced divisions of line sections.

Points device 1 according to the embodiment has two gap switches. A pair of rails 21*b*, 22*b* comprising connecting section "B" can be electrically disconnected from other rails in points device 1 irrespective of the-switching directions of tongue rails 23*a* to 23*d* by operating one gap switch. A pair of rails 21*d*, 22*d* comprising connecting section "D" can be electrically disconnected from other rails in points device 1 irrespective of the switching directions of tongue rails 23*a* to 23*d* by operating the other gap switch. Since the system does not need the setting of a gap separately by utilizing the gap switch built-in points device 1 per se, it can offer an improved convenience to the user. Although the embodiment describes points device 1 with two gap switches built-in, only one gap switch may be provided in either connecting section "B" or connecting section "D".

Second Embodiment

Figure 19:
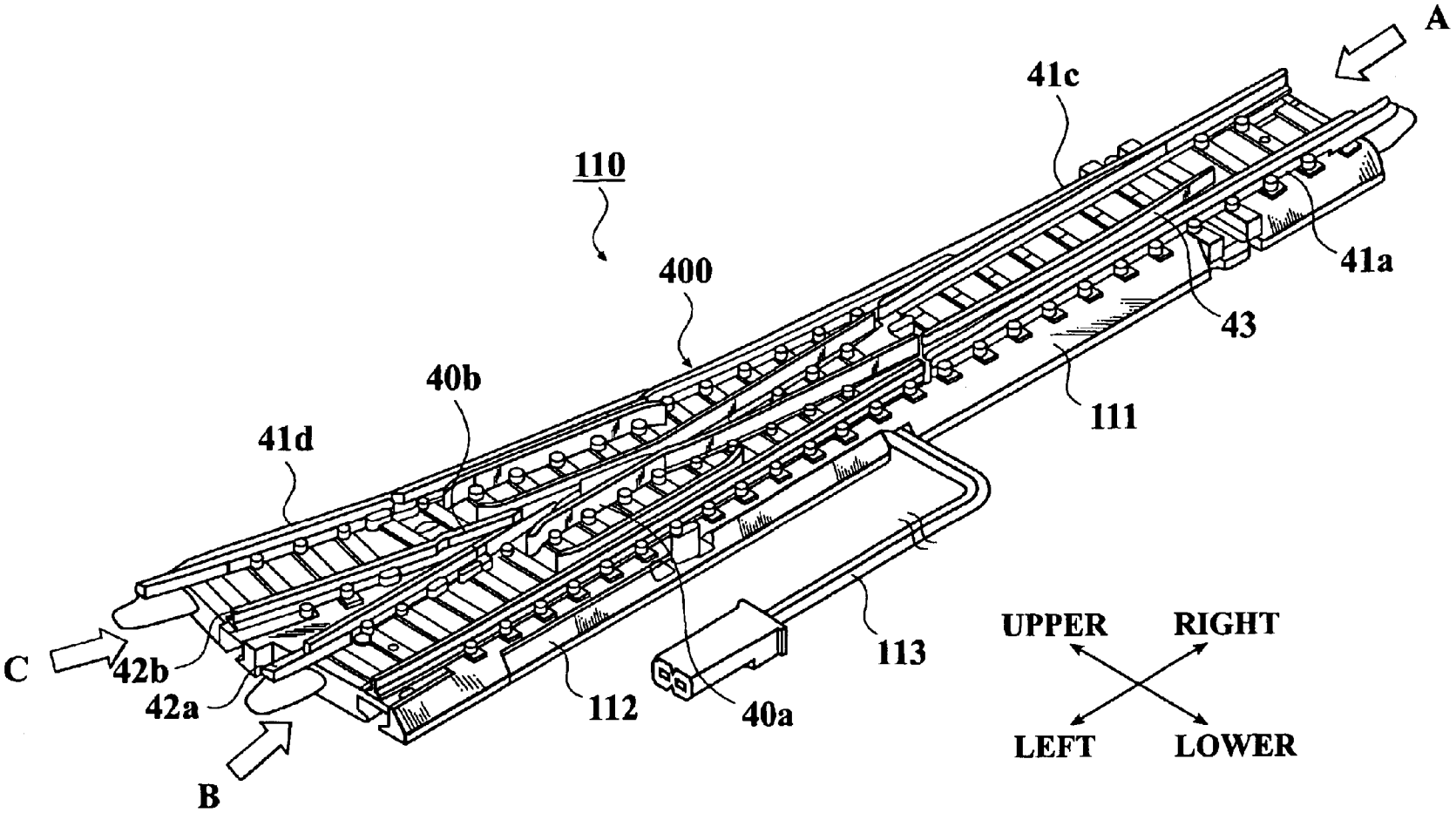
FIG. 19 is a perspective view of the points device according to the second embodiment.

Described is the embodiment where the present invention is applied to a multipurpose points device having a form in which tracks intersect in an almost Y-shape. FIG. 19 is a perspective view of a points device for toy railway according to a second embodiment. This points device 110 has three connecting sections "A" to "C" connectable with external rails and the traveling direction of a model train car is set to either a straight direction.(A–B) or a branched direction (A–C). For description's sake, connecting section "A" is positioned in the right direction, connecting section "B" is positioned in the lower left direction and connecting section "C" is positioned in the upper left direction.

This points device mainly comprises a group of rails 400 made of metal including outer rails, inner rails and the like, track bed 111 made of plastics on which a group of rails 400 is mounted, and drive unit 112. A detachable drive unit 112 is accommodated in an aperture provided on the side of track bed 111. Cord 113 connected to a controlling unit not illustrated is attached to drive unit 112. A driving current for switching a points device is supplied from the controlling unit side through this cord 113. There is provided a gap switch having the above-described constitution on connecting section "C" side of track bed 111.

Two frog pieces 40*a*, 40*b* are disposed in the vicinity of the center of track bed 111 where tracks intersect. Frog piece 40*a* is mounted on connecting section "B" side and frog piece 40*b* is mounted on connecting section "C" side. These two frog pieces 40*a*, 40*b* comprising frog.40 are so disposed as not to contact with each other.

Four outer rails 41*a* to 41*d* are mounted on track bed 111. Of these rails, two outer rails 41*a*, 41*b* are mounted in the vicinity of the lower section of track bed 111. Outer rail 41*a* at the lower right linearly extends inwardly from connecting section "A" at the right, and outer rail 41*b* at the lower left linearly extends inwardly from connecting section "-B" at the lower left. The inner tips of outer rails 41*a*, 41*b* are facing each other with slightly spaced relationship without contacting each other. With this constitution, two outer rails 41*a*,41*b* extending from the right to the left in the lower side communicate each other with the rails mutually insulated. On the other hand, two outer rails 41*c*, 41*d* are mounted in the vicinity of the upper side of track bed 111. Outer rail 41*c* at the upper right extends while it is curved like an arc inwardly from connecting section "A" at the right, and outer rail 41*d* at the upper left extends inwardly while it is curved like an arc from connecting section "C" at the upper left. The inside tips of these outer rails 41*c*, 41*d* are facing each other with slightly spaced relationship without contacting each other. With this constitution, two outer rails 41*c*, 41*d* extending from the right to the left in the lower side communicate each other with the rails mutually insulated.

On the other hand, inner rails 42*a*, 42*b* are mounted inside outer rails 41*b*, 41*d* on track bed 111 and these rails extend in parallel with outer rails 41*b*, 41*d* locationally corresponding thereto. Inner rail 42*a* at the lower left extends inwardly from connecting section "B" at the lower left, forming a pair with outer rail 41*b* outside the inner rail to form a track. Inner rail 42*b* at the upper left extends inwardly from connecting section "C" at the upper left, forming a pair with outer rail 41*d* outside the rail to form a track.

Tongue rail 43 selectively setting the traveling track of a train is mounted in the vicinity of the center of track bed 111. This tongue rail 43 extends from the vertex of frog 40 in connecting section "A" side to the right direction. This tongue rail 43 is rotatable around the center of the rotation axis provided on the side of the root thereof. However, the rotation range is regulated to a range from a position (straight line direction) at which the tip of tongue rail 43 contacts with outer rail 41*c* to a position (branch direction) at which the tip thereof contacts with outer rail 41*a*. The condition of the current-flow of tongue rail 43 is determined corresponding to a contacting point thereof. When the tip thereof is in contact with outer rail 41*c*, an electric power is supplied from outer rail 41*c* to tongue rail 43. On the other hand, when the tip thereof is in contact with outer rail 41*a*, an electric power is supplied from outer rail 41*a* to tongue rail 43.

Described is the position relation between outer rails 41*a* to 41*d* and inner rails 42*a* to 42*b* in points device 110. Each of outer rails 41*a* to 41*d* is disposed at the nearest position to the side of points device 110. In particular outer rail 41*a*, located in the lower side of points device 110, extends inwardly from the right end (connecting section "A") of points device 110. Similarly, outer rail 41*b*, located in the lower side, extends inwardly from the left end (connecting section "B") of points device 110. Although these outer rails 41*a*, 41*b* extend communicating with each other at the upper side of points device 110, they are so mutually insulated as to allow a current to flow in each rail by each separate system.

On the other hand, outer rail 41*c*, located at the upper side of points device 110, extends inwardly from the right end (connecting section "A") of points device 110. Similarly, outer rail 41*d*, located at the upper side thereof, extends inwardly from the left end (connecting section "C") of points device 110. Although these outer rails 41*c*, 41*d* extendcommunicating each other at the upper side of points device 110, they are so mutually insulated as to allow a current to flow in each rail by each separate system. Inner rails 42*a*, 42*b* are disposed inside outer rails 41*b*, 41*d*, each of which forming a pair with locationally corresponding outer rails 41*b*, 41*d* to form the tracks. In particular inner rail 42*a* which forms a pair with outer rail 41*b* at the lower left to form a track extends inwardly from connecting section "B" atthe lower left. Inner rail 42*b* which forms a pair with outer rail 41*d* at the upper left extends inwardly from connectingsection "C" at the upper left.

Figure 20:
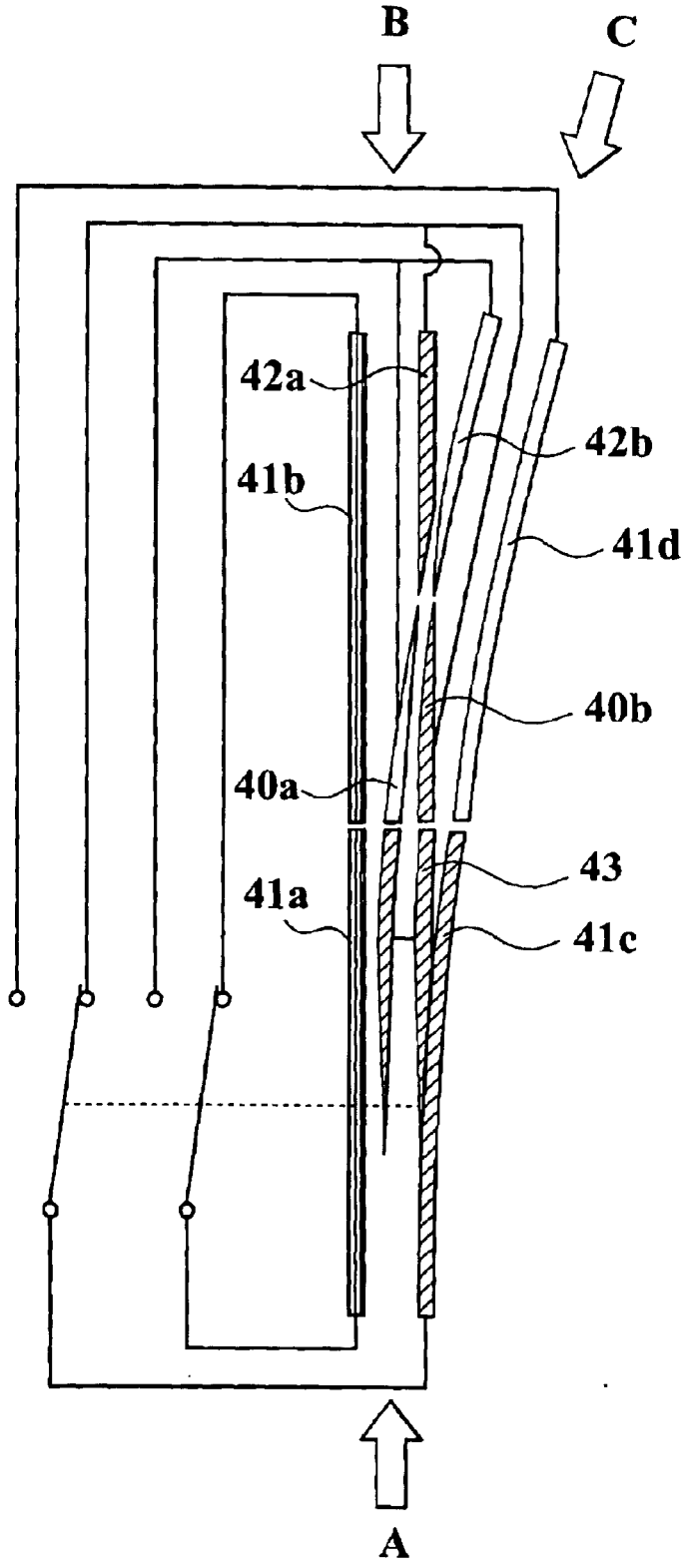
FIG. 20 is an explanatory view of the condition of the current-flow to rails in a straight line direction.

The running track of a train and the conditions of the current-flow to rails on points device 110 are set according to the switching direction (straight line direction or branch direction) of points device 110. FIG. 20 is an explanatory view showing the conditions of the current-flow to rails in the straight line direction. In this case, since tongue rail 43 contacts with outer rail 41*c*, a running track linking connecting section "A" with connecting. section "B" is formed. As for a running track linking connecting sections (A–B), outer rail 41*a* of connecting section "A" communicates with outer rail 41*b* of connecting section "B". Outer rail 41*c* of connecting section "A" communicates with inner rail 42*a* of connecting section "B" through tongue rail 43 and frog piece 40*b* contacting with this outer rail 41*c*.

Figure 21:
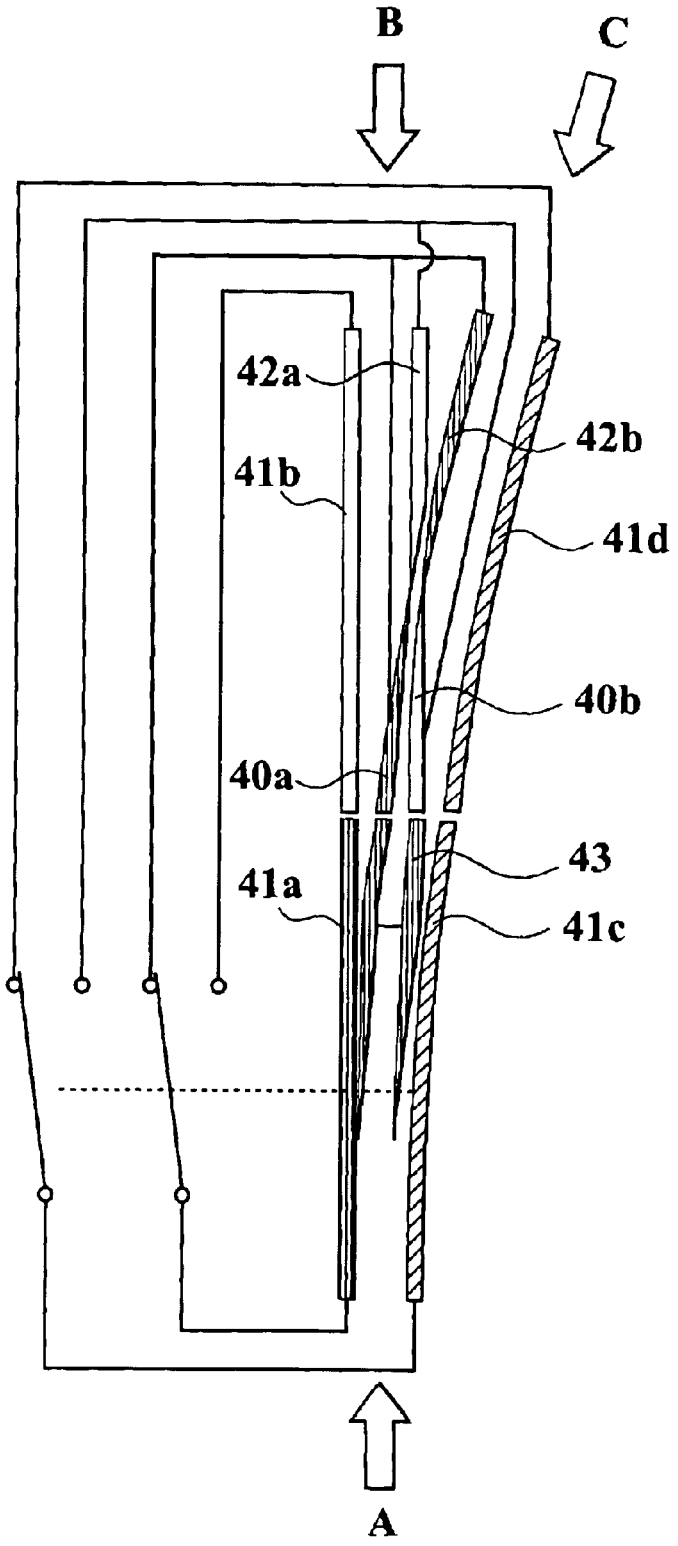
FIG. 21 is an explanatory view of condition of the current-flow to rails in a branching direction.

FIG. 21 is an explanatory view showing the conditions of the current-flow to rails in the branched direction. In this case, since tongue rail 43 contacts with outer rail 41*a*, a running track linking connecting section "A" connecting section "C" is formed. As for a track linking connecting section (A–C), outer rail 41*a* of connectingsection "A" communicates with inner rail 42*b* of connectingsection "C" through tongue rail 43 and frog piece 40*a* contacting with this outer rail 41*a*, and outer rail 41*c* connecting section "A" communicates with outer rail 41*d* of connecting section "C".

In tracks that can be thus shifted in the straight line direction or the branched direction, outer rails 41*a* to 41*d* are electrically connected or disconnected in separate groups by the direction of a track. When a track in the straight line direction is formed, outer rail 41*a* and 41*b* are electrically connected, and outer rail 41*c* and outer rail 41*d* are electrically disconnected. When a track in a branched direction is formed, outer rail 41*a* and 41*b* are electrically disconnected, and outer rail 41*c* and outer rail 41*d* are electrically connected.

Outer rails 41*a* to 41*d* and inner rails 42*a* and 42*b* are electrically connected or disconnected by the direction of a track. In particular, outer rail 41*a* is electrically connected with either outer rail 41*b* or inner rail 42*b*. Outer rail 41*c* which forms a pair with this outer rail 41*a* is electrically connected with either inner rail 42*a* or outer rail 41*d*. The electrical connections of these rails 41*a* to 41*d*, 42*a*, 42*b* are shifted by the direction of a track. When a track in the straight line direction is formed, outer rails 41*a*, 41*b* are electrically connected, and outer rail 41*c* and inner rail 42*a* are electrically connected. When a track in the branched direction is formed, outer rail 41*a* and inner rail 42*b* are electrically connected, and outer rails 41*c*, 41*d* are electrically connected.

The gap switch mechanism provided at connecting section "C" insulates a pair of rails equivalent to a connecting section to be gapped from other rails comprising points device 110 irrespective of the switching direction of points device 110. In particular, the mechanism insulates outer rail 41*d* and inner rail 42*d* of connecting section "C" from other rails comprising points device 110.

Thus, with points device 110 of a complete selection system according to the embodiment, it has an advantage that the current-flow control system of a layout can be simplified even if the layout becomes complicated due to the same reason as in the first embodiment. Together with the foregoing, it can offer an improved operability and convenience to the user since the number of operations of the current-flow switching can be reduced when a train is allowed to run by the number of reduced divisions of section lines. In addition, it can facilitate for the user to set a gap by providing a gap switch on points device 110 per se.

The entire disclosure of Japanese Patent Application No. Tokugan 2002-241690 which was filed on Aug. 22, 2002, including specification, claims, drawings and summary are incorporated herein by reference in its entirety.

What is claimed is:

1. A points device for toy railway, including a plurality of outer rails, a plurality of inner rails disposed inside the outer rails, and at least one tongue rails for selectively switching a traveling direction of a train, in which an electrical connection condition of rails is shifted according to a switching direction of the at least one tongue rail, comprising:

a first outer rail which is disposed in one side of the points device and extends inwardly from one end of the points device;

a second outer rail which is communicated with the first outer rail, which is disposed in the one side and extends inwardly from the other end of the points device, which is located opposite to the one end;

a third outer rail which is disposed in the other side of the points device, which is located opposite to the one side and extends inwardly from the one end;

a fourth outer rail which is communicated with the third outer rail, which is disposed on the other side and extends inwardly from the other end; and a switch section which is interlocked with the at least one tongue rail, and configured to be selectively moved into any one of the following operational positions; electrically connects or disconnects the first outer rail with the second outer rail, electrically connects or disconnects a first inner rail which forms a pair with the first outer rail, with a second inner rail which forms a pair with the second outer rail, electrically connects or disconnects the third outer rail with the fourth outer rail, and electrically connects or disconnects a third inner rail which forms a pair with the third outer rail, with a fourth inner rail which forms a pair with the fourth outer rail, corresponding to the switching direction of the at least one tongue rail.

2. The points device for toy railway according to claim 1, further comprising four connecting sections connectable with external railways, the connecting sections being double-slip points, two of the connecting sections being disposed at each of the one end and the other end, the four connecting sections comprising:

a first connecting section having a pair of the first outer rail and the first inner rail provided inside the first outer rail, the first connecting section being provided on the one side at the one end;

a second connecting section having a pair of the second outer rail and the second inner rail provided inside the second outer rail, the second connecting section being provided on the one side at the other end;

a third connecting section having a pair of the third outer rail and the third inner rail provided inside the third outer rail, the third connecting section being provided on the other side at the one end; and a fourth connecting section having a pair of the fourth outer rail and the fourth inner rail provided inside the fourth outer rail, the fourth connecting section being provided on the other side at the other end, wherein the switch section is interlocked with the at least one tongue rail, and electrically connects either the first outer rail or the third inner rail with the second outer rail, electrically connects either the first inner rail or the third outer rail with the second inner rail, electrically connects either the third inner rail or the first outer rail with the fourth inner rail and electrically connects either the first inner rail or the third outer rail with the fourth outer rail, corresponding to the switching direction of the at least one tongue rail.

3. The points device for toy railway according to claim 2, further comprising a first gap switch for electrically disconnecting the second outer rail and the second inner rail from other rails which form the double-slip points, irrespective of the switching direction of the at least one tongue rail.

4. The points device for toy railway according to claim 3, further comprising a second gap switch for electrically disconnecting the fourth outer rail and the fourth inner rail from other rails which form the double-slip points, irrespective of the switching direction of the at least one tongue rail.

5. The points device for toy railway according to claim 1, further comprising three connecting sections connectable with external railways, one of the three connecting sections being disposed at the one end and the other two connecting sections being disposed at the other end, the three connecting sections comprising:

a first connecting section having a pair of the first outer rail and the third outer rail, the first connecting section being provided at the one end;

a second connecting section having a pair of the second outer rail and the first inner rail provided inside the second outer rail, the second connecting section being provided on the one side at the other end; and a third connecting section having a pair of the fourth outer rail and the second inner rail disposed inside the fourth outer rail, the third connecting section being provided on the other side at the other end, wherein the switch section is interlocked with the at least one tongue rail, and electrically connects or disconnects the first inner rail with the third outer rail and electrically connects or disconnects the second inner rail with the first outer rail, corresponding to the switching direction of the at least one tongue rail.

6. The points device for toy railway according to claim 5, further comprising a gap switch for electrically disconnecting the fourth outer rail and the second inner rail from other rails irrespective of the switching direction of the at least one tongue rail.

7. A points device for toy railway including a plurality of outer rails, a plurality of inner rails disposed inside the outer rails, and at least one tongue rail for selectively switching a traveling direction of a train, in which an electrical connection condition of rails is shifted according to a switching direction of the tongue rail, comprising:

a first outer rail which is disposed in one side of the points device and extends inwardly from one end of the points device;

a second outer rail which is communicated with the first outer rail, which is disposed in the one side and extends inwardly from the other end of the points device, which is located opposite to the one end;

a third outer rail which is disposed in the other side of the points device, which is located opposite to the one side and extends inwardly from the one end;

a fourth outer rail which is communicated with the third outer rail, which is disposed on the other side and extends inwardly from the other end;

a switch section which is interlocked with the at least one tongue rail, and electrically connects or disconnects the first outer rail with the second outer rail, electrically connects or disconnects a first inner rail which forms a pair with the first outer rail, with a second inner rail which forms a pair with the second outer rail, electrically connects or disconnects the third outer rail with the fourth outer rail, and electrically connects or disconnects a third inner rail which forms a pair with the third outer rail, with a fourth inner rail which forms a pair with the fourth outer rail, corresponding to the switching direction of the at least one tongue rail;

a track bed on which the rails are mounted;

a backboard which is mounted at a back side of the track bed; and a plurality of wires formed on the backboard and electrically connected with the rails, wherein each of the wires extends toward a region at which the switch section is disposed.

8. A points device for toy railway including a plurality of outer rails, a plurality of inner rails disposed inside the outer rails, and at least one tongue rail for selectively switching a traveling direction of a train, in which an electrical connection condition of rails is shifted according to a switching direction of the at least one tongue rail, comprising:

a first outer rail which is disposed in one side of the points device and extends inwardly from one end of the points device;

a second outer rail which is communicated with the first outer rail, which is disposed in the one side and extends inwardly from the other end of the points device, which is located opposite to the one end;

a third outer rail which is disposed in the other side of the points device, which is located opposite to the one side and extends inwardly from the one end;

a fourth outer rail which is communicated with the third outer rail, which is disposed on the other side and extends inwardly from the other end; and a switch section which is interlocked with the at least one tongue rail, and electrically connects or disconnects the first outer rail with the second outer rail, electrically connects or disconnects a first inner rail which forms a pair with the first outer rail, with a second inner rail which forms a pair with the second outer rail, electrically connects or disconnects the third outer rail with the fourth outer rail, and electrically connects or disconnects a third inner rail which forms a pair with the third outer rail, with a fourth inner rail which forms a pair with the fourth outer rail, corresponding to the switching direction of the at least one tongue rail, four connecting sections connectable with external railways, the connecting sections being double-slip points, two of the connecting sections being disposed at each of the one end and the other end, the four connecting sections including; a first connecting section having a pair of the first outer rail and the first inner rail provided inside the first outer rail, the first connecting section being provided on the one side at the one end; a second connecting section having a pair of the second outer rail and the second inner rail provided inside the second outer rail, the second connecting section being provided on the one side at the other end; a third connecting section having a pair of the third outer rail and the third inner rail provided inside the third outer rail, the third connecting section being provided on the other side at the one end; and a fourth connecting section having a pair of the fourth outer rail and the fourth inner rail provided inside the fourth outer rail, the fourth connecting section being provided on the other side at the other end;

a track bed on which the rails are mounted;

a backboard which is mounted at a back side of the track bed; and a plurality of wires formed on the backboard and electrically connected with the rails, wherein the switch section is interlocked with the at least one tongue rail and electrically connects either the first outer rail or the third inner rail with the second outer rail, electrically connects either the first inner rail or the third outer rail with the second inner rail, electrically connects either the third inner rail or the first outer rail with the fourth inner rail, and electrically connects either the first inner rail or the third outer rail with the fourth outer rail, corresponding to the switching direction of the at least one tongue rail, and wherein each of the wires extends toward a region at which the switch section is disposed.

9. A points device for toy railway including a plurality of outer rails, a plurality of inner rails disposed inside the outer rails, and at least one tongue rail for selectively switching a traveling direction of a train, in which an electrical connection condition of rails is shifted according to a switching direction of the at least one tongue rail, comprising;

a first outer rail which is disposed in one side of the points device and extends inwardly from one end of the points device;

a second outer rail which is communicated with the first outer rail, which is disposed in the one side and extends inwardly from the other end of the points device, which is located opposite to the one end;

a third outer rail which is disposed in the other side of the points device, which is located opposite to the one side and extends inwardly from the one end;

a fourth outer rail which is communicated with the third outer rail, which is disposed on the other side and extends inwardly from the other end;

a switch section which is interlocked with the at least one tongue rail, and electrically connects or disconnects the first outer rail with the second outer rail, electrically connects or disconnects a first inner rail which forms a pair with the first outer rail, with a second inner rail which forms a pair with the second outer rail, electrically connects or disconnects the third outer rail with the fourth outer rail, and electrically connects or disconnects a third inner rail which forms a pair with the third outer rail, with a fourth inner rail which forms a pair with the fourth outer rail, corresponding to the switching direction of the at least one tongue rail;

three connecting sections being disposed at the one end and the other two connecting sections being disposed at the other end, the three connecting sections including:

a first connecting section having a pair of the first outer rail and the third outer rail, the first connecting section being provided at the one end;

a second connecting section having a pair of the second outer rail and the first inner rail provided inside the second outer rail, the second connecting section being provided on the one side at the other end; and a third connecting section having a pair of the fourth outer rail and the second inner rail disposed inside the fourth outer rail, the third connecting section being provided on the other side at the other end, wherein the switch section is interlocked with the at least one tongue rail, and electrically connects or disconnects the first inner rail with the third outer rail and electrically connects or disconnects the second inner rail with the first outer rail, corresponding to the switching direction of the at least one tongue rail;

a track bed on which the rails are mounted;

a backboard which is mounted at a back side of the track bed; and a plurality of wires formed on the backboard and electrically connected with the rails, wherein the switch section is interlocked with the at least one tongue rail and electrically connects either the first outer rail or the third inner rail with the second outer rail, electrically connects either the first inner rail or the third outer rail with the second inner rail, electrically connects either the third inner rail or the first outer rail with the fourth inner rail and electrically connects either the first inner rail or the third outer rail with the fourth outer rail, corresponding to the switching direction of the at least one tongue rail, and wherein each of the wires extends toward a region at which the switch section is disposed.

* * * * *